US007672625B2

(12) United States Patent
Takahashi et al.

(10) Patent No.: US 7,672,625 B2
(45) Date of Patent: Mar. 2, 2010

(54) DEVELOPING DEVICE USING ELECTROSTATIC TRANSPORT AND HOPPING (ETH)

(75) Inventors: Tomoko Takahashi, Kanagawa (JP); Katsuhiro Aoki, Kanagawa (JP); Hideki Zemba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 202 days.

(21) Appl. No.: 11/681,940

(22) Filed: Mar. 5, 2007

(65) Prior Publication Data

US 2007/0212121 A1 Sep. 13, 2007

(30) Foreign Application Priority Data

Mar. 9, 2006 (JP) ..... 2006-063589
Jan. 26, 2007 (JP) ..... 2007-015704

(51) Int. Cl.
*G03G 15/08* (2006.01)
*G03G 15/06* (2006.01)
*G03G 15/09* (2006.01)

(52) U.S. Cl. ..... 399/265; 399/55; 399/270; 399/271

(58) Field of Classification Search ..... 399/55, 399/235, 265, 266, 285, 289, 290, 291, 270, 399/271

See application file for complete search history.

(56) References Cited

U.S. PATENT DOCUMENTS 6,597,884 B2 7/2003 Miyaguchi et al.
6,708,014 B2 3/2004 Miyaguchi et al.
6,901,231 B1 5/2005 Sakai et al.
6,941,098 B2 9/2005 Miyaguchi et al.
6,947,691 B2 9/2005 Miyaguchi et al.

(Continued)

FOREIGN PATENT DOCUMENTS

JP 3-21967 1/1991

(Continued)

OTHER PUBLICATIONS

U.S. Appl. No. 12/042,892, filed Mar. 5, 2008, Tsukamoto, et al.

(Continued)

*Primary Examiner*—Hoang Ngo
(74) *Attorney, Agent, or Firm*—Oblon, Spivak, McClelland, Maier & Neustadt, L.L.P.

(57) ABSTRACT

A developing device, process cartridge, and image forming apparatus that use ETH development, and are capable of forming good multi-color images with a simple construction, and are capable of preventing the dispersal of powder. The developing device is for developing latent images on a latent image carrying member by applying powder to the latent image carrying member, and comprises: a transport member disposed in opposition to the latent image carrying member and having a plurality of transport electrodes that generate a progressive wave electric field to move the powder; a voltage supply device for applying a multi-phase voltage to the transport electrodes; and a transport member surface potential determination device for determining the surface potential of the transport member. The voltage supply device in the developing device according to the present invention applies a multi-phase voltage to the transport electrodes so that the surface potential on the transport member is between the potential of the image portions and the potential of the non-image portions of the latent image carrying member.

12 Claims, 23 Drawing Sheets

U.S. PATENT DOCUMENTS

| | | | | |
|---|---|---|---|---|
| 7,024,142 | B2 | 4/2006 | Sakai et al. | |
| 7,062,204 | B2 | 6/2006 | Miyaguchi et al. | |
| 7,123,864 | B2 | 10/2006 | Miyaguchi et al. | |
| 2005/0025525 | A1 | 2/2005 | Horike et al. | |
| 2005/0158073 | A1 | 7/2005 | Nakazato et al. | |
| 2005/0175377 | A1* | 8/2005 | Sakai et al. | 399/266 |
| 2006/0120765 | A1 | 6/2006 | Sakai et al. | |
| 2006/0210320 | A1 | 9/2006 | Nakagawa et al. | |
| 2006/0216071 | A1 | 9/2006 | Yamada et al. | |
| 2006/0251449 | A1 | 11/2006 | Takahashi et al. | |

FOREIGN PATENT DOCUMENTS

| | | |
|---|---|---|
| JP | 5-31146 | 5/1993 |
| JP | 5-31147 | 5/1993 |
| JP | 8-3673 | 1/1996 |
| JP | 9-329947 | 12/1997 |
| JP | 3376199 | 11/2002 |
| JP | 2004-198744 | 7/2004 |

OTHER PUBLICATIONS

U.S. Appl. No. 12/049,838, filed Mar. 17, 2008, Senoh, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.
U.S. Appl. No. 12/261,302, filed Oct. 30, 2008, Kosugi, et al.
U.S. Appl. No. 12/209,812, filed Sep. 12, 2008, Aoki, et al.
U.S. Appl. No. 12/176,054, Jul. 18, 2008, Kadota, et al.

* cited by examiner

DEVELOPING DEVICE USING ELECTROSTATIC TRANSPORT AND HOPPING (ETH)

BACKGROUND OF THE INVENTION

1. Field of the Invention

The present invention relates to a developing device, a process cartridge, and an image forming apparatus, and more particularly relates to a developing device that uses Electrostatic Transport & Hopping (ETH) and that can obtain high developing efficiency with low voltage drive, a process cartridge and an image forming apparatus that includes this developing device.

2. Description of the Background Art

Image forming apparatuses such as copying machines, printers, or facsimile machines use a xerographic process to form a latent image on an latent image carrying member. A powder developer (hereafter referred to as toner) is applied to the latent image to develop the latent image so that a toner image is made visible. This toner image is transferred onto a recording medium, or temporarily transferred onto an intermediate transfer member before being transferred onto the recording medium, to form images.

In this type of image forming apparatus, it is known that conventionally in the developing device that develops latent images formed on the latent image carrying member, toner that is agitated within the developing device is carried on the surface of a developer carrying member, or a developing roller. By rotating the developing roller the toner is transported to a position in opposition to the surface of the latent image carrying member, and the latent image on the latent image carrying member is developed. Then after completion of developing, toner that has not been transferred to the latent image carrying member is recovered within the developing device by the rotation of the developing roller. Then toner is newly agitated, charged, and again transported by being carried on the developing roller.

Also, as disclosed in Japanese Patent Application Laid-open No. H9-197781 and Japanese Patent Application Laid-open No. H9-329947, conventional image forming apparatuses are known which develop using the so-called jumping developing method. In this type of image forming apparatus DC and AC superimposed voltages are applied between the latent image carrying member and the developing roller. The toner is then transferred from the developing roller to the latent image carrying member without contact.

Further, as disclosed in Japanese Patent Application Laid-open No. H5-031146, Japanese Patent Application Laid-open No. H5-031147, and elsewhere, other conventional image forming apparatuses have been proposed in which toner is transported to a position in opposition to the latent image carrying member using an electrostatic transport substrate. The toner is vibrated, suspended, and aerosolized, and separates from the transport surface due to the force of attraction between the toner and the latent image carrying member and adheres to the surface of the latent image carrying member. Also, as disclosed in Japanese Patent Application Laid-open No. H8-003673, image forming apparatuses that obtain color images by superimposing toner in many colors onto the latent image, in which the method of making the toner jump from the developing roller is used are known. Also, as disclosed in Japanese Patent Application Laid-open No. H3-021967, image forming apparatuses have been proposed in which superimposed developing is carried with toner that has been suspended by the electric field curtain effect.

However, in image forming apparatuses having a developing device that provides toner to the latent image carrying member using a developing roller as described above, toner penetrates between the developing roller and the side plate of the developing device, causing rubbing and accretion of toner. This can adversely affect images, as the sealant material around the developing device deteriorates with age, and images become dirty due to suspension of toner caused by agitation and charging of developer or toner within the developing device.

Also, when toner is charged by friction charging or corona discharge charging, toner that is a mixture of saturated charged toner and unsaturated charged toner is obtained, that has a large charge distribution. If this kind of toner is forcibly transferred to the developing roller using a magnetic brush or transfer roller, some of the toner with a small charge that is carried on the developing roller separates from the developing roller, due to the developing speed (linear speed about 100 cm/sec.) of the developing roller. As a result toner becomes suspended, and the images formed can become dirty.

Further, in developing devices that use so-called jumping development, toner charged by a high voltage must be provided. Therefore, a high voltage source is required, which can create the problems of increasing the size of the device and increasing the cost. Also, the current problem for image forming apparatuses using powder is how to satisfy the requirements of image quality, cost, and environment.

Also, when forming a color image, for image quality 1200 dpi isolated dots of only 30 μm diameter must be formed. For this purpose also it is desirable that developing be carried with no dirt. Further, reducing cost is important, not just the cost of the developing unit and the toner, but also the total cost including maintenance and final disposal cost. Also, for the environment it is important to prevent toner which is a fine powder from being dispersed within or outside the device.

Technologies relating to the present invention are also disclosed in, for example, Japanese Patent No. 3,376,199.

SUMMARY OF THE INVENTION

It is an object of the present invention to solve these problem points, and provide a developing device, process cartridge, and image forming apparatus using electrostatic transport and hopping (ETH) that is capable of forming good multi-color images with a simple configuration, and is capable of preventing dispersion of powder.

In an aspect of the present invention, a developing device applies powder to a latent image carrying member to develop latent images on the latent image carrying member. The developing device comprises a transport member disposed in opposition to the latent image carrying member, and having a plurality of transport electrodes for generating electric fields to transport powder; a voltage supply device for applying n phase (where n is a positive integer equal to or greater than 2) voltage to the transport electrodes; and a transport member surface potential determination device for determining the surface potential of the transport member. The voltage supply device applies the n phase voltage to the transport electrodes so that the surface potential on the transport member is between the potential of the image portions and the potential of the non-image portions of the latent image carrying member.

In another aspect of the present invention, a process cartridge has at least a developing device for developing latent images on a latent image carrying member by applying powder to the latent image carrying member. The process cartridge can be freely inserted into and removed from a main body of an image forming apparatus. The process cartridge comprises a transport member disposed in opposition to the latent image carrying member and having a plurality of transport electrodes that generate electric fields to transport powder; a voltage supply device for applying n phase (where n is a positive integer equal to or greater than 2) voltage to the transport electrodes; and a transport member surface potential determination device for determining the surface potential of the transport member. The voltage supply device applies the n phase voltage to the transport electrodes so that the surface potential on the transport member is between the potential of the image portions and the potential of the non-image portions of the latent image carrying member.

In another aspect of the present invention, an image forming apparatus comprises either a developing device that applies powder to a latent image carrying member to develop latent images on the latent image carrying member, or a process cartridge. The developing device comprises a transport member disposed in opposition to the latent image carrying member and having a plurality of transport electrodes that generate electric fields to transport powder; a voltage supply device for applying n phase (where n is a positive integer equal to or greater than 2) voltage to the transport electrodes; and a transport member surface potential determination means for determining the surface potential of the transport member. The voltage supply device applies the n phase voltage to the transport electrodes so that the surface potential on the transport member is between the potential of the image portions and the potential of the non-image portions of the latent image carrying member. The process cartridge comprises at least the developing device, and can be freely inserted into and removed from the main body of the image forming apparatus.

In another aspect of the present invention, a color image forming apparatus comprises a plurality of process cartridges including at least a developing device for developing latent images on a latent image carrying member by applying powder to the latent image carrying member. The process cartridge can be freely inserted into and removed from the main body of the image forming apparatus. The developing device comprises a transport member disposed in opposition to the latent image carrying member and having a plurality of transport electrodes that generate electric fields to transport powder; a voltage supply device for applying n phase (where n is a positive integer equal to or greater than 2) voltage to the transport electrodes; and a transport member surface potential determination device for determining the surface potential of the transport member. The voltage supply device applies the n phase voltage to the transport electrodes so that the surface potential on the transport member is between the potential of the image portions and the potential of the non-image portions of the latent image carrying member.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

The following is a detailed explanation of the present invention with reference to the drawings.

In the following explanation, the ETH phenomenon is the phenomenon in which phase shift electric field energy is applied to a powder, the energy is converted into mechanical energy, and the powder itself moves dynamically. This ETH phenomenon includes both movement (carrying) in the horizontal direction of the powder, and movement (hopping) in the vertical direction due to electrostatic forces. As a result of the phase shift field, the powder hops from the surface of an electrostatic transport member with a component in the direction of movement. The developing method that uses this ETH phenomenon is called ETH development. Also, in the present specification, to distinguish the behavior of powder on the transport member in the ETH phenomenon, the expressions "carrying", "carrying velocity", "carrying direction", and "carrying direction" are used to refer to movement in the horizontal direction on the substrate. For movement in a direction perpendicular to the substrate, the expressions "hopping", "hopping velocity", "hopping direction", and "hopping height (distance)" are used. For "carrying and hopping" on the transport substrate, the general term "transport" is used.

Figure 1:
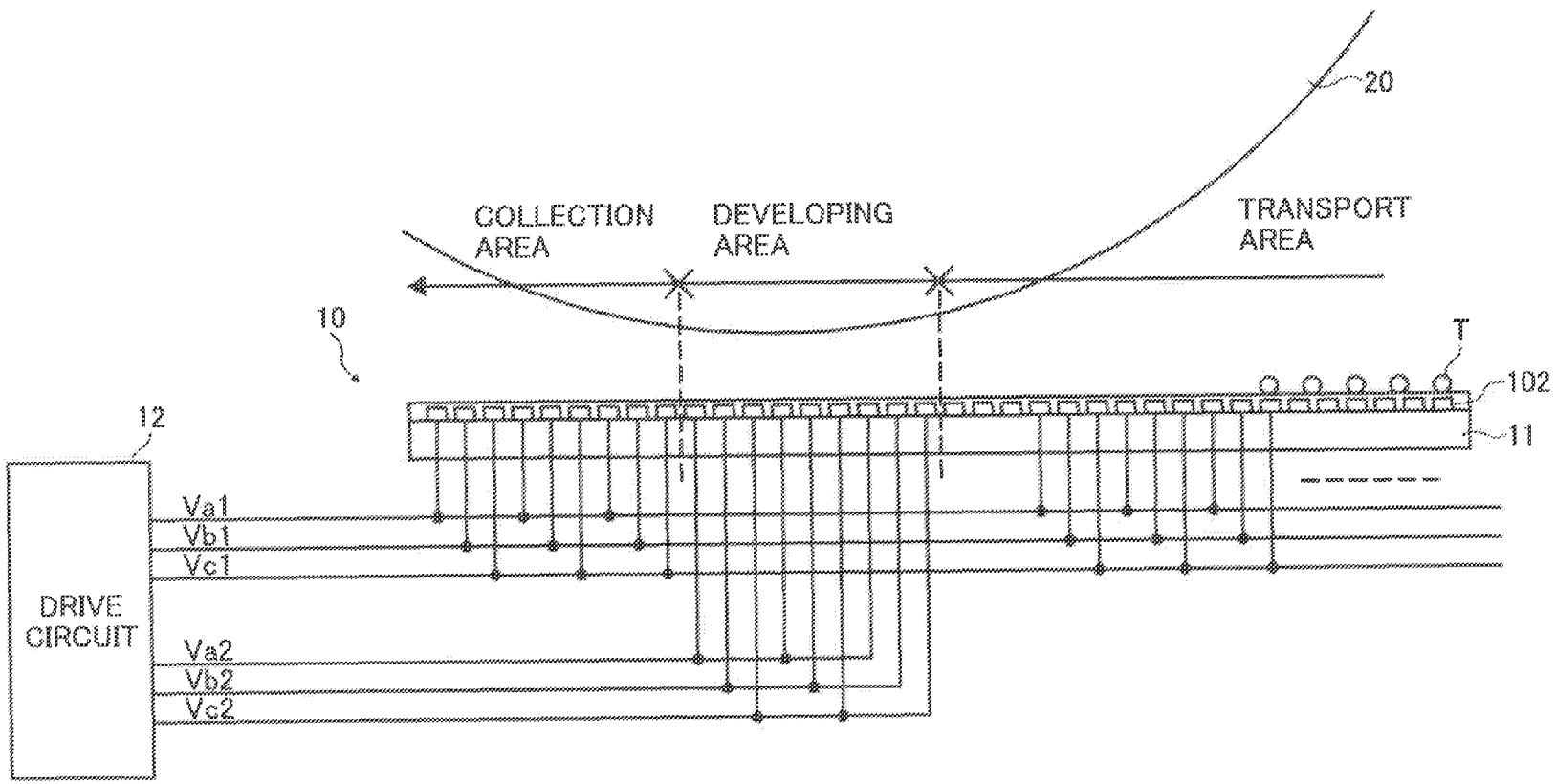
FIG. 1 is a diagram showing the schematic structure of a developing device according to an embodiment of the present invention.

FIG. 1 is shows the schematic structure of a developing device according to an embodiment of the present invention. The developing device 10 shown in this figure includes a transport substrate 11 which is a transport member having a plurality of transport electrodes 102 that generate an electric field for carrying, hopping, and collecting toner T, which is a powder. To generate the required electric field, different n-phase (where n is a positive integer that is 2 or more, here there are 3 phases) wave forms Va1, Vb1, Vc1, and Va2, Vb2, Vc2 are applied to each transport electrode 102 of the transport substrate by a drive circuit 12. Here, in the relationship between the range of the transport electrodes 102 that provide waveforms Va1, Vb1, Vc1, and Va2, Vb2, Vc2 and the photosensitive drum 20 as the latent image carrying member, the transport substrate 11 is divided into a transport area, a developing area, and a collection area. The transport area is the area in which toner T is transported to near a photosensitive drum 20 which is a latent image carrying member. The developing area is an area in which the toner T adheres to the latent image on the photosensitive drum 20 to form toner images. The collection area is an area after the developing area for collecting the toner T on the transport substrate 11.

In the developing device 10, in the transport area of the transport substrate 11, the toner is transported to near the photosensitive drum 20. In the developing area electric fields are generated so that for the image portions of the latent image of the photosensitive drum 20 the toner T is directed towards the photosensitive drum 20 side, and for the non-image portions of the latent image the toner T is directed in the opposite direction to the photosensitive drum 20 (towards the transport substrate 11), thereby electric fields for applying the toner T to the latent image for development are generated. In the collection area electric fields are generated so that the toner T is directed towards the opposite direction to the photosensitive drum 20 (towards the transport substrate 11), regardless of the image portions or non-image portions of the latent image.

Figure 2:
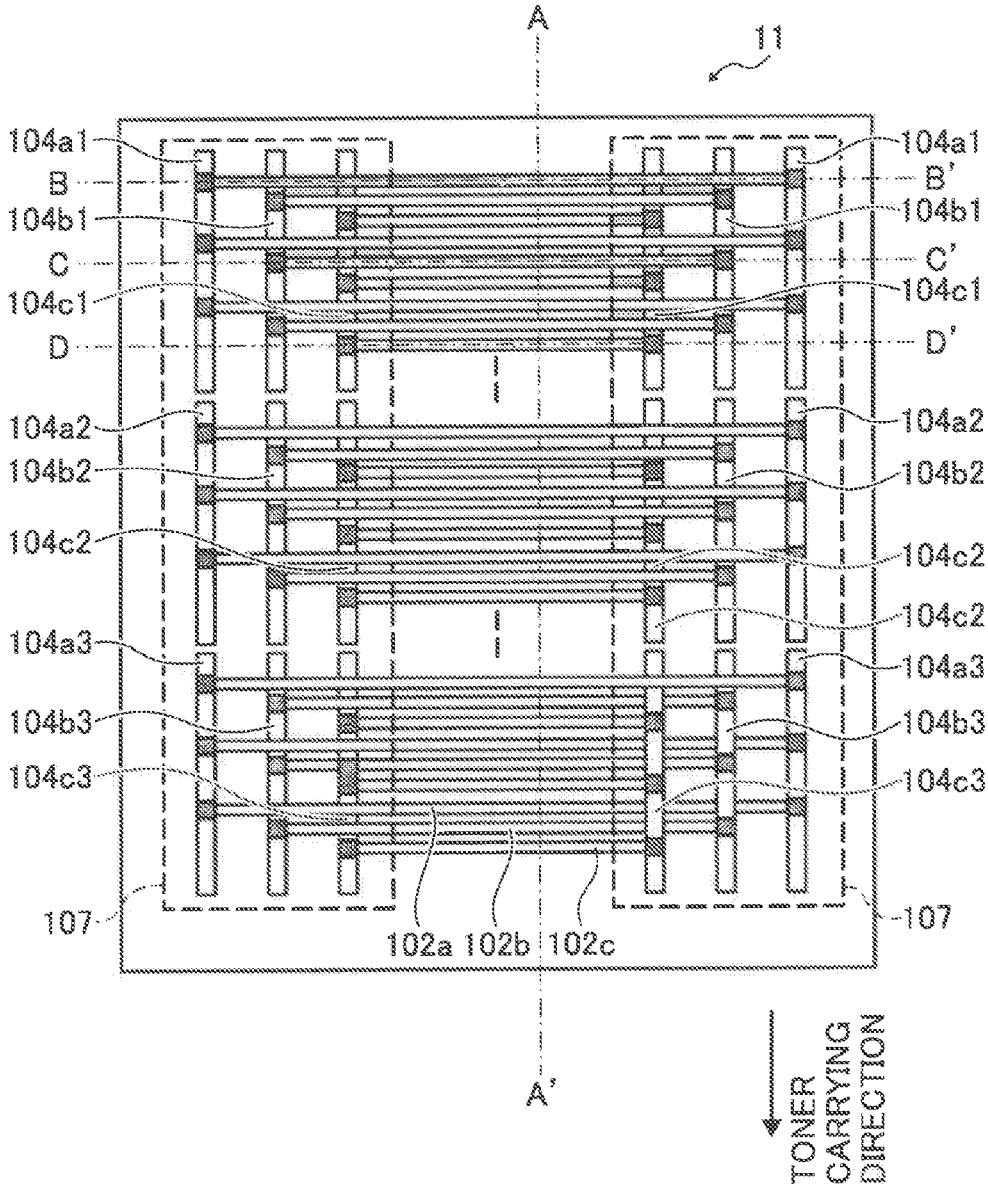
FIG. 2 is a plan view showing the structure of the transport substrate of the developing device.
Figure 3:
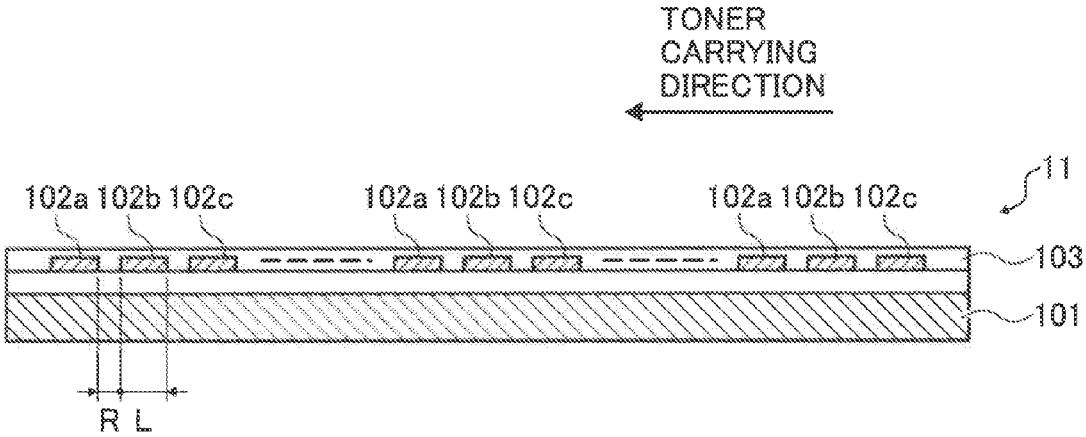
FIG. 3 is a sectional view on the line A-A' in FIG. 2.
Figure 4:
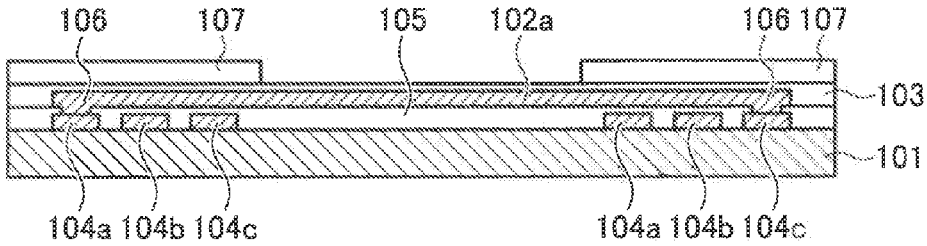
FIG. 4 is a sectional view on the line B-B' in FIG. 2.
Figure 5:
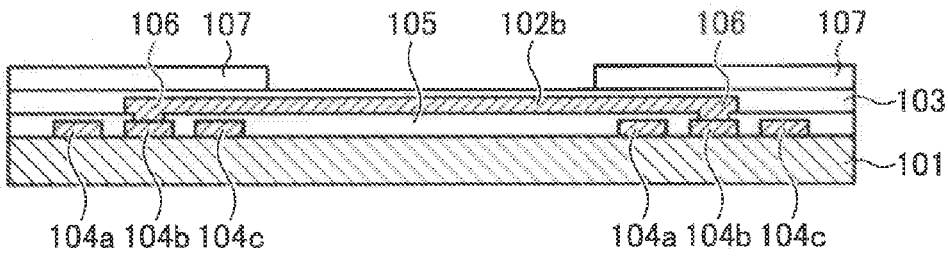
FIG. 5 is a sectional view on the line C-C' in FIG. 2.
Figure 6:
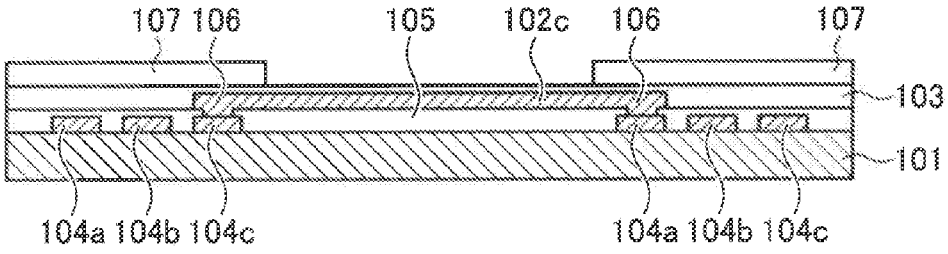
FIG. 6 is a sectional view on the line D-D' in FIG. 2.

Here the structure of the transport substrate of the developing device according to an embodiment of the present invention is explained in detail, with reference to FIGS. 2 through 6. FIG. 2 is a plan view of the transport substrate; FIG. 3 is the sectional view A-A' in FIG. 2; FIG. 4 is the sectional view B-B' in FIG. 2; FIG. 5 is the sectional view C-C' in FIG. 2; and FIG. 6 is the sectional view D-D' in FIG. 2.

The transport substrate 11 of the developing device according to the present embodiment includes a set of three transport electrodes 102*a*, 102*b*, 102*c* (these are collectively referred to as the transport electrodes 102) on a support substrate 101 in FIG. 3. The transport electrodes 102 are formed repeatedly in a direction substantially normal to the toner carrying direction indicated by the arrow direction in FIGS. 2 and 3, and at predetermined intervals along the toner carrying direction. A surface protection layer 103 formed from an inorganic or organic insulating material is provided above the transport electrodes 102, forming an insulating member that covers the surface of the transport electrode 102 that forms the transport surface forming member. The surface protection layer 103 forms a protective membrane that covers the surface of the transport electrodes 102. Here the surface protection layer 103 forms the transport surface. However, a separate membrane with superior compatibility with the powder (toner) may be further formed on the surface protection layer 103.

Common electrodes 104*a*, 104*b* and 104*c* (also referred to collectively as "common electrodes 104") , which are mutually connected to the transport electrodes 102*a*, 102*b* and 102*c* at both ends thereof, respectively, are provided on both sides of the electrode sets and are disposed along the toner carrying direction, in other words, in a direction substantially normal to each of the transport electrodes 102*a*, 102*b* and 102*c*. The width (width in the direction normal to the toner carrying direction) of the common electrodes 104 is greater than the width (width along the toner carrying direction) of the electrodes 102. As shown in FIG. 2, the common electrodes 104 in the transport area, the developing area, and the collecting area are denoted by reference symbols 104*a*1, 104*b*1, and 104*c*1, reference symbols 104*a*2, 104*b*2, and 104*c*2, and reference symbols 104*a*3, 104*b*3, and 104*c*3, respectively.

Here, as shown in FIG. 4, after forming the pattern of common electrodes 104*a*, 104*b*, 104*c* on the support substrate 101, an inter-layer insulation film 105 is formed. Contact holes 106 are formed in the inter-layer insulation film 105, then the transport electrodes 102*a*, 102*b*, 102*c* are formed, so that the transport electrodes 102*a*, 102*b*, 102*c* are mutually connected to the common electrodes 104*a*, 104*b*, 104*c*. The material of the inter-layer insulation film 105 may or may not be the same material as the surface protection layer 103. Also, the electrodes maybe formed in a three-layer structure. In other words, the transport electrodes 102*a* and the common electrodes 104*a* may be formed as an integral pattern, on top of which an inter-layer insulation film 105 is formed. Then on top of the inter-layer insulation film 105 the transport electrodes 102*b* and the common electrodes 104*b* may be formed as an integral pattern, on top of which a further inter-layer insulation film 105 is formed. Then on top of the inter-layer insulation film 105 the transport electrodes 102*c* and the common electrodes 104*c* may be formed as an integral pattern. Alternatively, integrally formed mutual connections and mutual connections formed with contact holes 106 may be mixed.

Further, input terminals (not shown on the drawings) for applying drive signals (drive waveform) Va, Vb, Vc are provided on the common electrodes 104*a*, 104*b*, 104*c* for inputting drive signals (drive wave forms) from a drive circuit 12 shown in FIG. 1. The drive signal input terminals may be provided on the rear surface of the support substrate 101 connected to the common electrodes 104 by through holes. Alternatively, drive signal input terminals may be provided on the inter-layer insulation film 105.

Here the support substrate 101 is a substrate made from an insulating material such as glass substrate, resin substrate, or ceramics substrate. Alternatively a substrate made from an electrically conducting material such as stainless steel on which an insulating film such as $SiO_2$ or similar is formed, or a substrate made from a material that can deform flexibly such as a polyimide film may be used.

Also, the transport electrodes 102 are formed by forming an Al or Ni—Cr film 0.1 to 10 μm thick, preferably 0.5 to 2.0 μm thick on the support substrate 101. This film is then formed into the required electrode pattern using photolithography or similar. The width L of the plurality of transport electrodes 102 in the toner carrying direction is within the range from one to 20 times the average particle diameter of the powder to be transported. Also, the interval between electrodes R of the plurality of transport electrodes 102 in the toner carrying direction is within the range from one to 20 times the average particle diameter of the powder to be transported.

The surface protection layer 103 is obtained by forming a film of for example $SiO_2$, $TiO_2$, $TiO_4$, SiON, BN, TiN, $Ta_2O_5$, $ZrO_2$, $BaTiO_2$, or the like to a thickness of 0.5 to 10 μm, preferably within the range 0.5 to 3 μm. Also, an inorganic nitride compound such as for example SiN, Bn, or W may also be used. In particular, since the amount of charge on the toner tends to decrease in the course of carrying as the amount of surface hydroxyl groups increases, it is preferable to use inorganic nitride compounds with fewer surface hydroxyl groups (SiOH, silatol group).

Next, the principle of electrostatic transport of toner on the transport substrate 11 configured in this way is explained. When a drive wave form of n phases is applied to the transport electrodes 102 of the transport substrate 11, a phase shift electric field (progressive wave electric field) is generated among the plurality of electrodes 102. Therefore, charged toner on the transport substrate 11 is affected by a repulsion force or an attraction force and is carried in the carrying direction while hopping.

Figure 7:
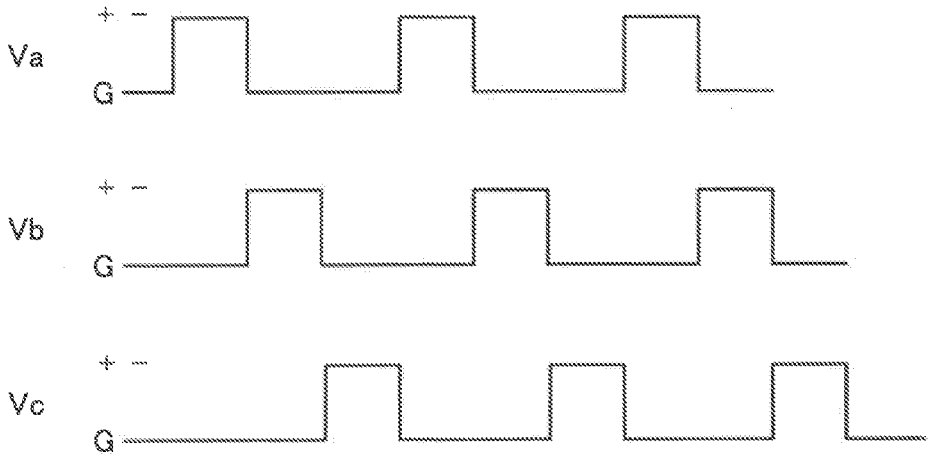
FIG. 7 is a wave form diagram showing an example of a drive wave form applied to the transport substrate.

For example, the three phase pulse shaped drive wave forms (drive signals) A (A phase), B (B phase), C (C phase) that vary between ground G (0V) and a positive voltage + as shown in FIG. 7 are applied to the transport electrodes 102 of the transport substrate 11 with their timing staggered.

Figure 8:
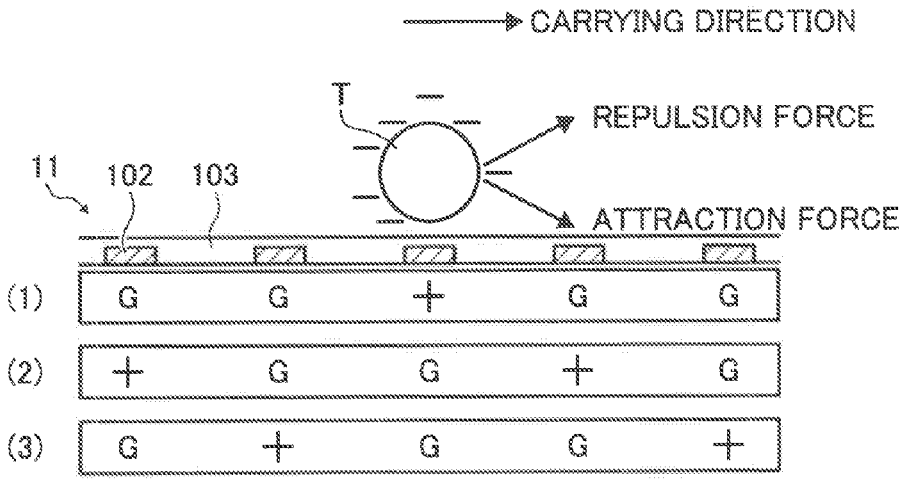
FIG. 8 is a diagram showing the carrying and hopping of powder.

At this time, there is negatively charged toner T on the transport substrate 11, as shown in FIG. 8. If [G], [G], [+], [G], [G] is applied to the continuous plurality of transport electrodes 102 on the transport substrate 11 as shown in (1) in FIG. 8, the negatively charged toner T will be attracted to the position of the [+] transport electrode 102.

At the next timing [+], [G], [G], [+], [G] is applied to the plurality of transport electrodes 102 as shown in (2). A repulsion force acts between the negatively charged toner T and the [G] transport electrode 102 on the left hand side in the figure. However, an attraction force acts between the negatively charged toner T and the [+] transport electrode 102 on the right hand side. Therefore the negatively charged toner T moves towards the [+] transport electrode 102. Further, at the next timing [G], [+], [G], [G], [+] is applied to the plurality of transport electrodes 102 as shown in (3). The repulsion force and the attraction force acts on the negatively charged toner T in the same way, so the negatively charged toner T moves further towards the [+] transport electrode 102.

In this way, a progressive wave electric field is generated on the transport substrate 11 by applying multi-phase drive wave forms with varying voltage to the plurality of transport electrodes 102. The negatively charged toner T is carried while hopping in the direction of the progressive wave electric field. In the case of positively charged toner T, by reversing the pattern of variation of the drive wave form, in the same way the movement is in the same direction.

Figure 9A:
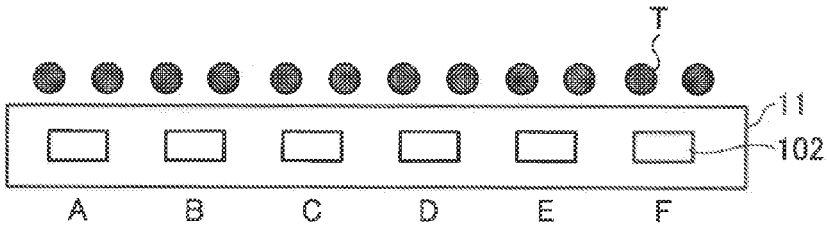
FIG. 9A through 9D are diagrams showing specific examples of carrying and hopping.
Figure 9B:
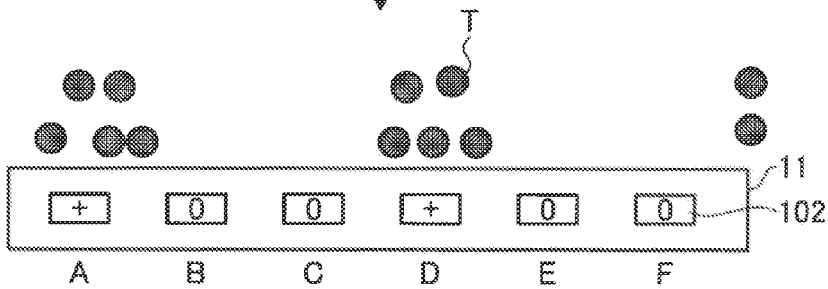
Figure 9C:
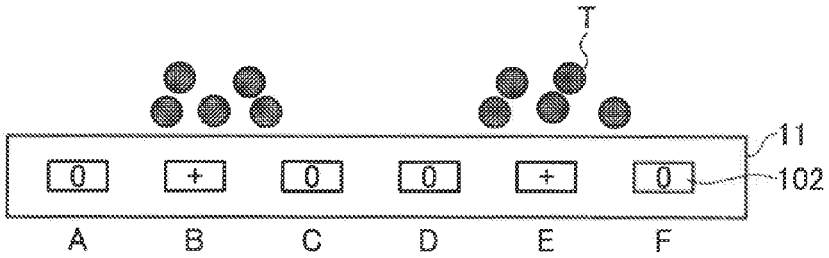
Figure 9D:
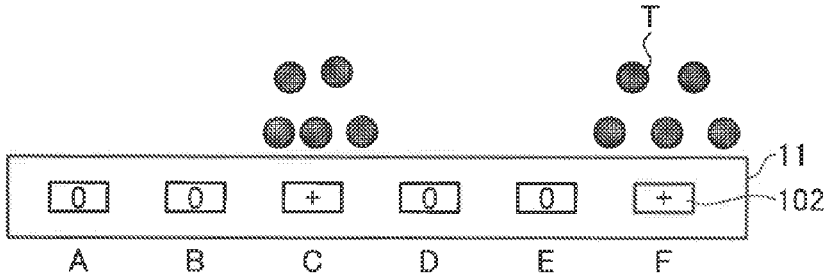

The following is a more specific explanation of the toner T carrying phenomenon, with reference to FIGS. 9A through 9D. FIG. 9A shows the situation where the transport electrodes A through F in the transport substrate 11 are each at 0 V (G), and negatively charged toner T is on the top of the transport substrate 11. FIG. 9B shows the case where from the situation in FIG. 9A, [+] is applied to the transport electrodes A, D. The negatively charged toner T is attracted to and moves towards the transport electrode A and the transport electrode D. At the next timing, transport electrodes A and D are both [0], while [+] is applied to transport electrodes B and E, as shown in FIG. 9C. Repulsion forces act on the toner T at transport electrodes A, D, and attraction forces act towards transport electrodes B, E. Therefore the negatively charged toner T is carried to transport electrode B and transport electrode E. Further, at the next timing, transport electrodes B and E are both [0], while [+] is applied to transport electrodes C and F, as shown in FIG. 9D. Repulsion forces act on the toner T at transport electrodes B, E, and attraction forces act towards transport electrodes C, F. Therefore the negatively charged toner T is carried to transport electrode C and transport electrode F. In this way the negatively charged toner T is progressively carried to the right by the progressive wave electric field.

Figure 10:
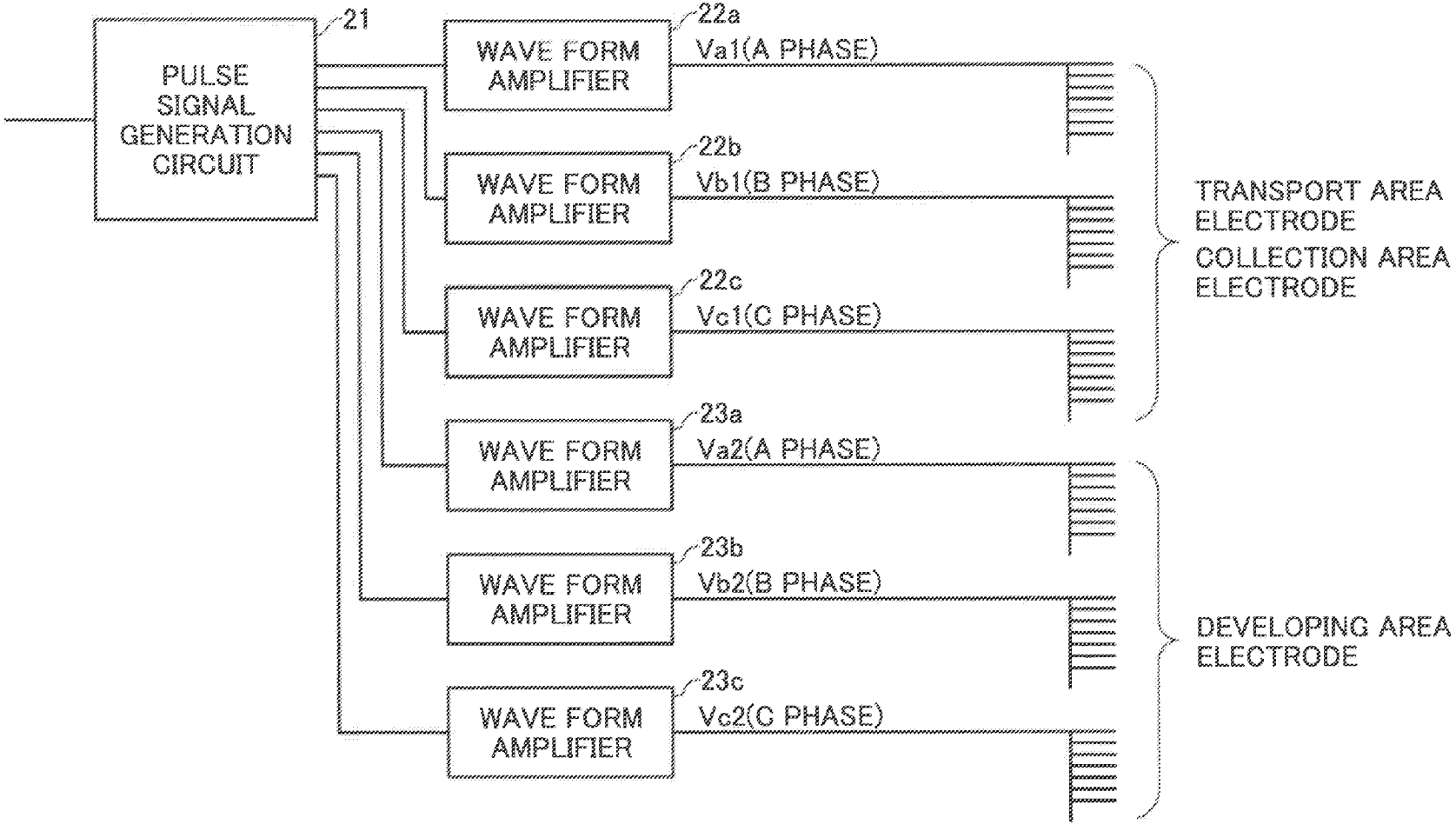
FIG. 10 a block diagram showing an example of the structure of the drive circuit of FIG. 1.

Next, the overall configuration of the drive circuit in FIG. 1 is explained with reference to FIG. 10.

The drive circuit 12 includes a pulse signal generation circuit 21, wave form amplifiers 22*a*, 22*b*, 22*c*, and wave form amplifiers 23*a*, 23*b*, 23*c*. The pulse signal generation circuit 21 generates and outputs pulse signals. The wave form amplifiers 22*a*, 22*b*, 22*c* receive the pulse signals from the pulse signal generation circuit 21 and generate and output the drive wave forms Va1, Vb1, Vc1. The wave form amplifiers 23*a*, 23*b*, 23*c* receive the pulse signals from the pulse signal generation circuit 21 and generate and output the drive wave forms Va2, Vb2, Vc2. Also, the pulse signal generation circuit 21 receives, for example, an input pulse having a logic level and drives switching means (not shown in the drawings), for example a transistor, included in the waveform amplifiers 22*a* through 22*c* and 23*a* through 23*c* of the next stage by two set of pulses with phases shifted 120 degrees from each other. Then, the pulse signal generation circuit 21 outputs a pulse signal with an output voltage 10 to 15 V of a level at which switching of 100 V can be performed.

Figure 11:
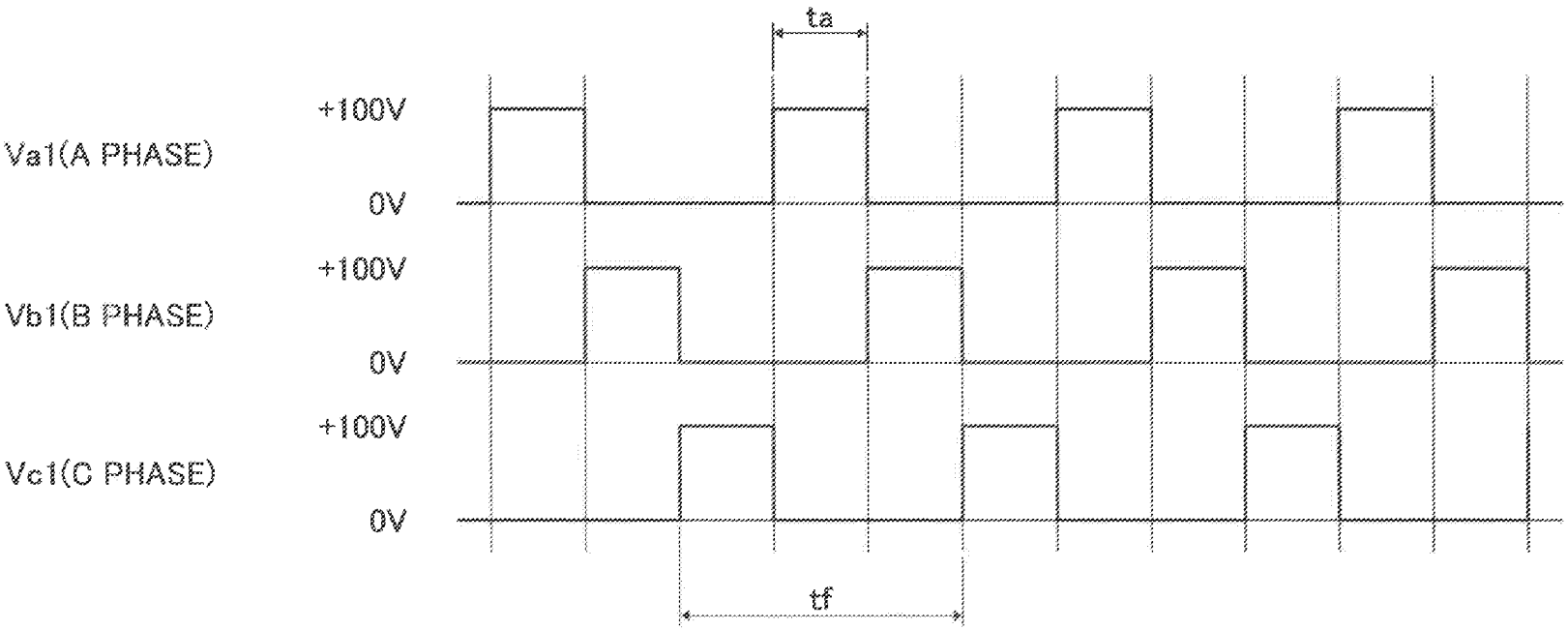
FIG. 11 is a time chart showing an example of the drive wave form of the transport voltage pattern and the collecting and transport voltage pattern.
Figure 12:
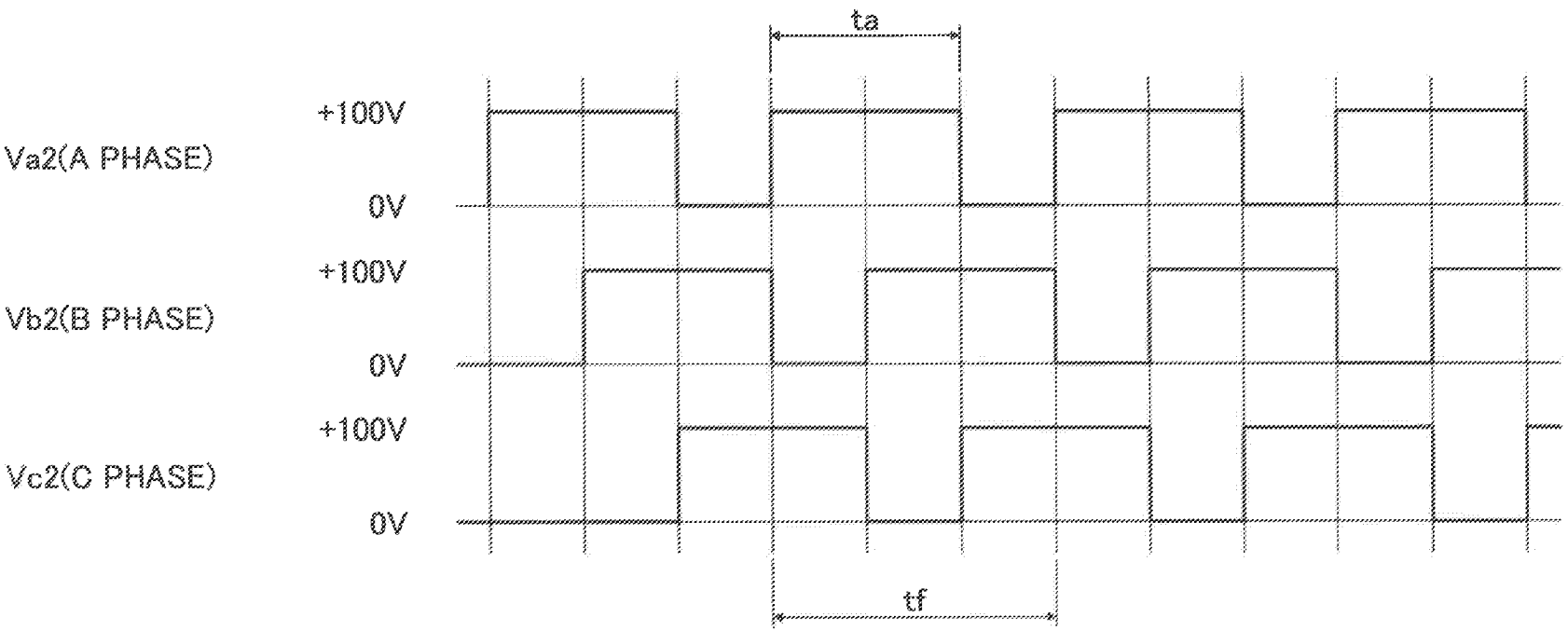
FIG. 12 is a time chart showing an example of the drive wave form of the hopping voltage pattern.
Figure 13:
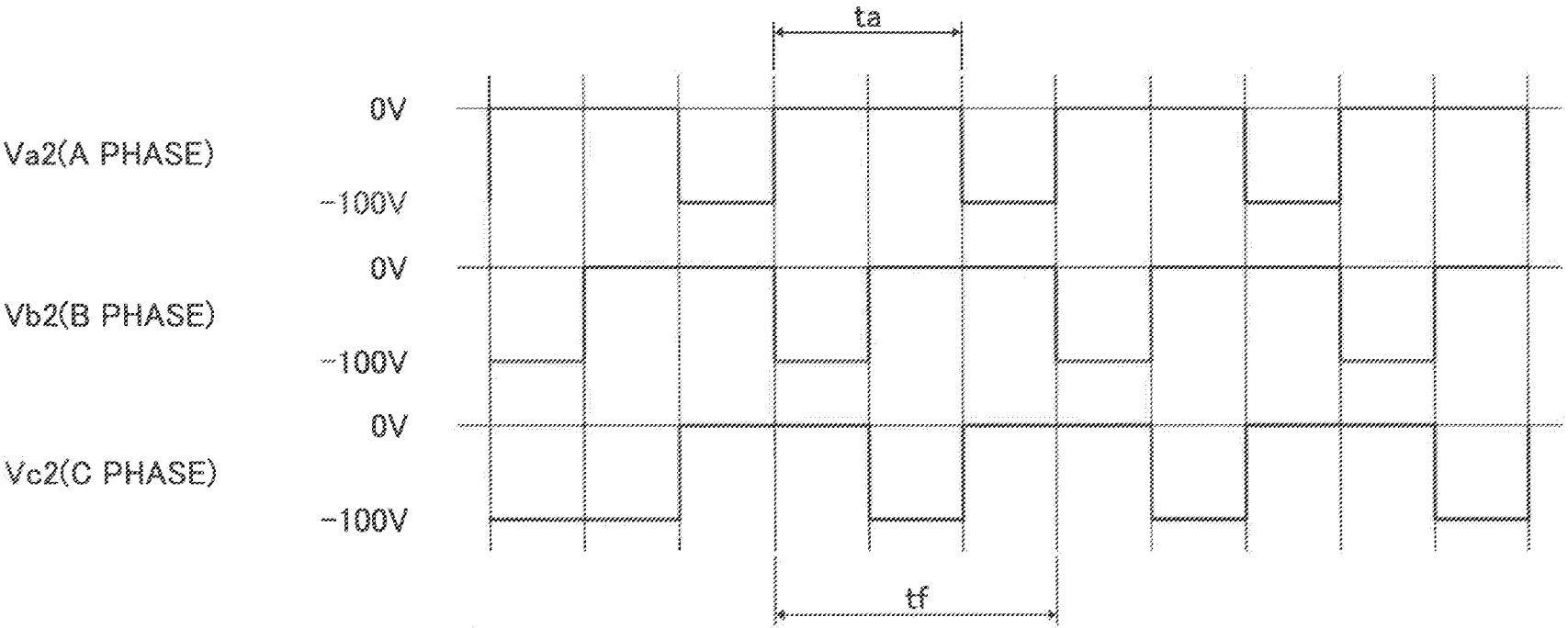
FIG. 13 is a time chart showing an example of another drive wave form of the hopping voltage pattern.

Also, the wave form amplifiers 22*a*, 22*b* and 22*c* apply the three phase drive wave forms (drive pulses) Va1, Vb1 and Vc1 to each of the transport electrodes 102 of the transport area and the transport electrodes 102 of the collecting area shown in FIG. 1. As shown in FIG. 11, the drive signals Va1, Vb1, Vc1 have three phases A, B and C for which the application time ta of +100 V is set to about 33% equivalent to ⅓ of the repetition period tf (hereafter referred to as the "transport voltage pattern" or the "collecting transport voltage pattern"). Further, the wave form amplifiers 23*a*, 23*b*, and 23*c* output the three phase drive wave forms (drive pulses) Va2, Vb2 and Vc2 to each of the transport electrodes 102 of the developing area shown in FIG. 1. For example, as shown in FIGS. 12 and 13, the drive signals Va2, Vb2, and Vc2 have three phases A, B and C in which the application time ta of +100 V or 0 V is set to about 67% equivalent to ⅔ of the repetition period tf. Hereafter the drive signals of the three phases A, B, and C are also referred to as the "hopping voltage pattern".

As explained above, ETH development uses electrostatic transport of toner. However, this ETH development does not utilize smoking and clouding of toner which naturally occur due to the electrostatic movement as in a conventional developing device using the electrostatic transport. Instead the toner is positively made to hop toward the latent image carrying member to carry out developing. Also, ETH development does not occur simply by using a conventional electrostatic transport substrate, but occurs by appropriately setting the relationship among the electrode width, the electrode interval, and the drive waveform.

The following is an explanation of the electrode width L and electrode interval R of the plurality of transport electrodes 102 of the transport substrate 11, and the surface protection layer 103.

The electrode width L and electrode interval R of the transport substrate 11 greatly affect the toner carrying efficiency and hopping efficiency. In other words, toner in the space between transport electrode and transport electrode is moved to an adjacent transport electrode on the substrate surface by a virtually horizontal electric field. In contrast, toner on a transport electrode is given an initial velocity with at least a component in the normal direction, so most of the toner hops and separates from the surface of the substrate. In particular, toner near an electrode end surface hops over the adjacent transport electrode. Therefore if the electrode width L is wide, the number of toner particles on the electrode becomes large, the number of toner particles that move a long distance increases, and the carrying efficiency increases. However, if the width of the electrode L is too wide, the electric field strength near the center of the electrode reduces, so toner adheres to the transport electrodes, and the carrying efficiency reduces. Therefore, the present invention has discovered that there is an ideal electrode width for carrying and hopping of powder with good efficiency at low voltage.

Also, as for the electrode interval R the electric field strength between electrodes is determined by the relationship between distance and applied voltage, so the narrower the interval R the stronger the electric field strength, and the easier it is to obtain the initial carrying and hopping velocity. However, for toner moving from transport electrode to transport electrode, if the movement distance in one time is short the movement efficiency does not increase unless the drive frequency increases. On this matter also the present invention has discovered that there is an ideal electrode interval for carrying and hopping powder with good efficiency at low voltage.

Also, as for the electrode interval R the electric field strength between electrodes is determined by the relationship between distance and applied voltage, so the narrower the interval R the stronger the electric field strength, and the easier it is to obtain the initial carrying and hopping velocity. However, for toner moving from electrode to electrode, if the movement distance in one time is short the movement efficiency does not increase unless the drive frequency increases. On this matter also the present invention has discovered that there is an ideal electrode interval for carrying and hopping powder with good efficiency at low voltage.

Further, the thickness of the surface protection layer 103 that covers the electrode surfaces also affects the electric field strength on the electrode surfaces. In particular, it has been discovered that the effect on the component in the vertical direction of the electrical lines of force is large, and determines the hopping efficiency.

Therefore, by appropriately setting the relationship between the electrode width, the electrode interval, and the thickness of the surface protection layer 103 of the transport substrate, it is possible to solve the problem of toner adhering to the electrode surfaces, and obtain efficient movement at low voltage.

The following is a detailed explanation. First, if the electrode width L is equal to the toner diameter (powder diameter), the width dimension is sufficient for carrying and hopping the minimum one particle of toner. If the electrode width is narrower than this, the electric field acting on the toner becomes smaller, the carrying and hopping force reduces, and for practical purposes is insufficient. Also, as the electrode width L becomes wider, in particular near the center of the surface of the electrodes, the electrical lines of force become inclined towards the direction of carrying (the horizontal direction), so an area in which the electric field is weak in the vertical direction occurs, and the hopping generation force becomes smaller. If the electrode width L becomes too wide then in the extreme depending on the charge on the toner, adhesion forces such as mirror image forces, Van Der Waals forces, moisture, and so on can become dominant, and deposition of toner can occur.

Also, regarding the efficiency of carrying and hopping, if the electrode width is wide enough to carry twenty toner particles thereon, adhesion hardly occurs, and efficient carrying and hopping are possible with a drive waveform with a low voltage of about 100 V. If the electrode width L is larger than that, an area in which adhesion partially occurs is formed. For example, if the average particle diameter of the toner is assumed to be 5 μm, the electrode width L corresponds to a range from 5 μm to 100 μm.

A more preferable range for the electrode width L is between two and ten times the average diameter of the powder, in order to obtain more efficient driving by the drive wave form with an applied voltage of 100 V or less. By setting the electrode width L within this range, the reduction in electric field strength near the center of the surface of the electrode is kept to less than ⅓, the reduction in hopping efficiency is 10% or less, so there is no significant reduction in efficiency. This corresponds to a range of 10 μm to 50 μm assuming for example that the average toner diameter is 5 μm.

It is still more preferable to set the electrode width L to between two and six times the average diameter of the powder. This corresponds to a range of 10 μm to 30 μm assuming for example that the average toner diameter is 5 μm. It has been found that the efficiency is greatly improved by setting the electrode width L to a value within this range.

Figure 14:
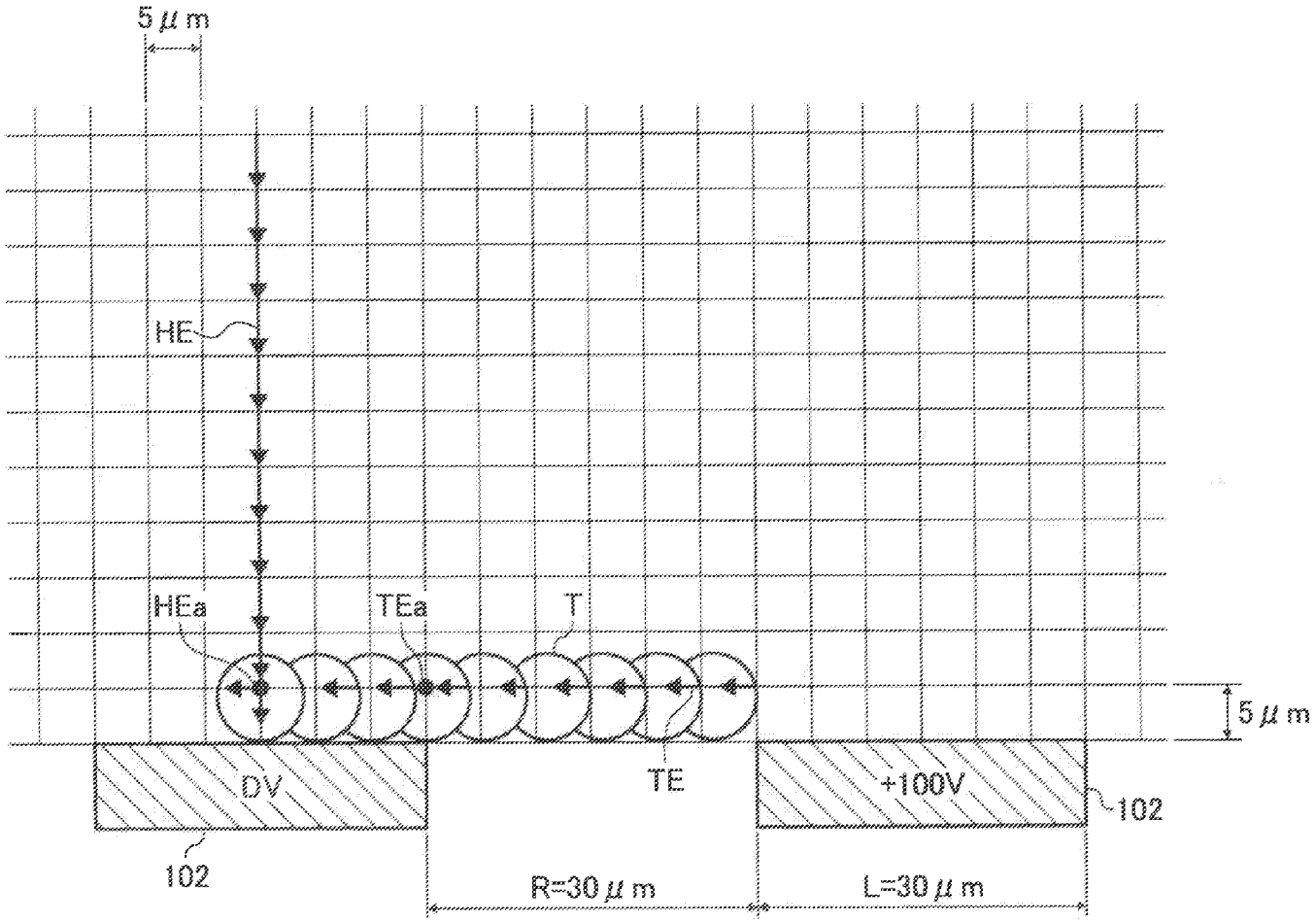
FIG. 14 is a diagram showing the electrode width and electrode spacing of the transport substrate of the developing device.

Here, the strength of the carrying electric field TE and the hopping electric field HE relative to the electrode width L and electrode interval L were measured for the transport electrodes 102 of the transport substrate 11 in FIG. 1, as shown in FIG. 14. The electrode width L was set to 30 μm, the electrode interval R was set to 30 μm, the thickness of the transport electrodes 102 was set to 5 μm, the thickness of the surface protection layer 103 was set to 0.1 μm, and the voltages applied to adjacent transport electrodes 102 were +100 V and 0 V respectively. The results are shown in FIGS. 15 and 16.

The data for each evaluation included simulation and actual measurements. High speed video was used to measure and evaluate the behavior of the toner particles. FIG. 14 only shows two transport electrodes 102 for ease of understanding. However the actual simulations and tests were evaluated for an area having a sufficient number of transport electrodes as described previously. Also, the particle diameter of the toner T was 8 μm, and the electric charge was −20 μC/g.

Figure 15:
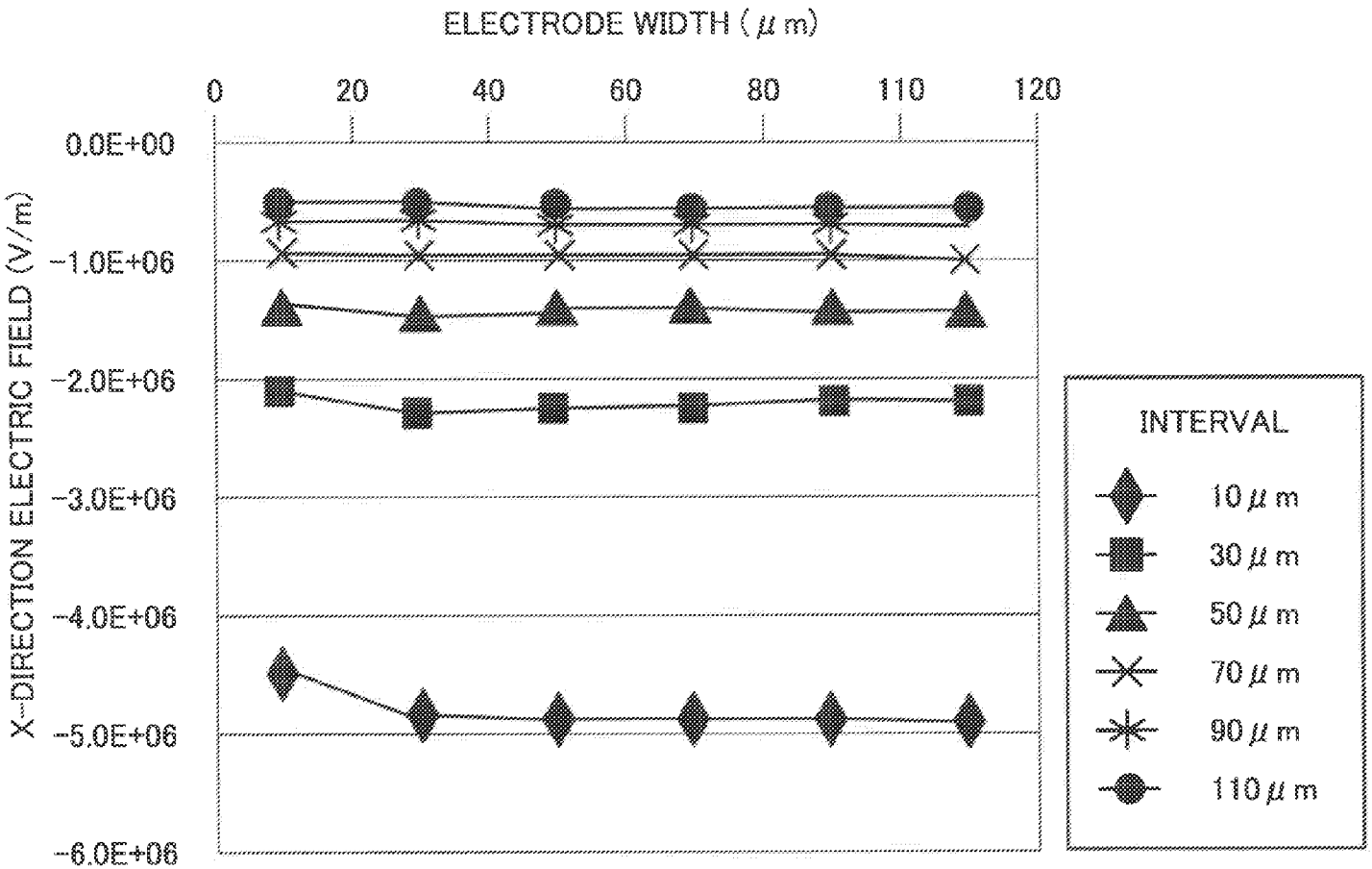
FIG. 15 is a characteristic diagram showing an example of the relationship between electrode width and the electric field (X direction) at the 0 V electrode end.
Figure 16:
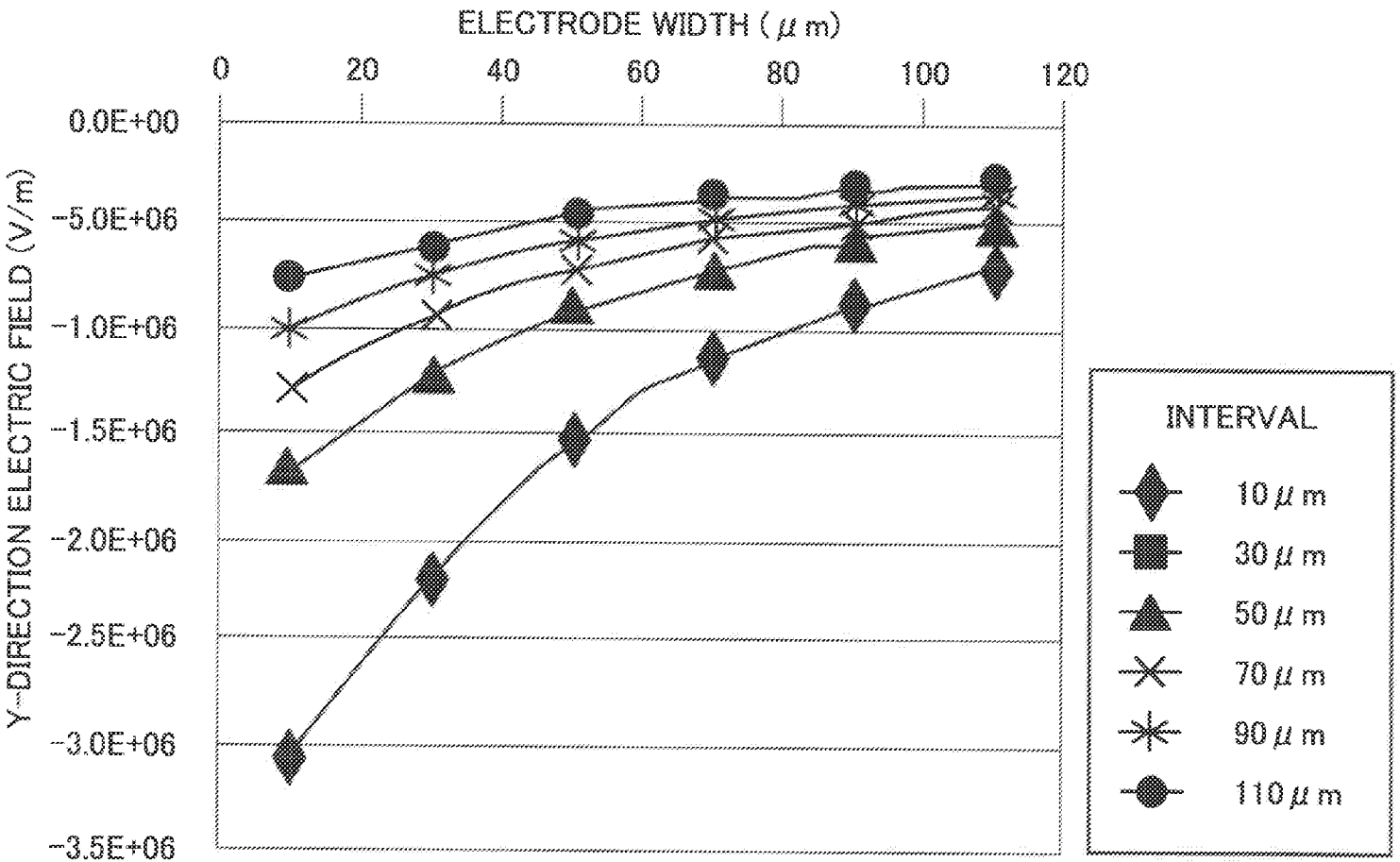
FIG. 16 is a characteristic diagram showing an example of the relationship between electrode width and the electric field (Y direction) at the 0 V electrode end.

The electric field strengths shown in FIGS. 15 and 16 are for representative points on the surface of the electrodes. The representative point TEa for the carrying electric field TE is a point 5 μm above the edge of an electrode as shown in FIG. 14. The representative point HEa for the hopping electric field HE is a point 5 μm above the center of an electrode as shown in FIG. 14. These points correspond to representative points in the X direction and Y direction in which the electric field acting on the toner is strongest.

From FIGS. 15 and 16 it can be seen that the electric field is not less than the level at which forces that can activate carrying and hopping can be applied to the toner, 5E+5 V/m, and not less than the level that is desirable to avoid problems with adhesion, 1E+6 V/m. Further, it can be seen that the electric field is in a more preferred range for providing sufficient force, 2E+6 V/m or greater.

As the electrode interval R increases, the electric field strength in the carrying direction reduces. Therefore, similarly the electrode interval R should be within the range one to 20 times, preferably within the range 2 to 10 times, and more preferably within the range 2 to 6 times the average particle diameter, as values corresponding to the range of electric field strength above.

Also, from FIG. 16 it can be seen that the hopping efficiency reduces as the electrode interval R increases. However, in practice efficient hopping can be obtained for electrode intervals R up to 20 times the average particle diameter. When the electrode interval R exceeds 20 times the average toner diameter, most of the toner cannot overcome the adhesion forces, and some of the toner cannot generate any hopping. Therefore, from this point also it is necessary that the electrode interval R is equal to or less than 20 times the average toner particle diameter.

As above, the electric field strength in the Y direction is determined by the electrode width L and the electrode interval R, the narrower in both cases the higher the electric field strength. Also, the electric field strength in the X direction near the edge of the electrodes is also determined by the electrode interval R, the narrower the electrode interval R the higher the electric field strength.

In this way, by setting the width of the electrodes in the direction of movement of the toner, and the interval of the electrodes in the direction of movement of the toner within the range one to 20 times the average toner particle diameter, sufficient electrostatic force can act for toner carrying and hopping and to overcome adhesion forces such as mirror image forces, Van Der Waals forces, and so on. Stagnation of toner can be prevented, and stable and efficient carrying and hopping can be achieved.

Also, in particular, when the toner average particle diameter is within 2 to 10 μm, and Q/M is in the range −3 to −40 μC/g, preferably −10 to −30 μC/g in the case of negative charge, or +3 to +40 μC/g, preferably +10 to +30 μC/g in the case of positive charge, efficient carrying and hopping can be obtained with the electrode configuration as described above.

As explained above, in ETH development, reversal development of electrostatic latent images on the latent image carrying member can be carried out by the one component developing method. In other words, developing can be carried out by providing electric field forming means such that in the developing area toner adheres to the image portions of the latent image on the latent image carrying member, and toner does not adhere to the non-image portions of the latent image carrying member.

Also, whether or not toner on the transport substrate adheres to the latent image carrying member is determined by the relationship between the potential of the latent image carrying member and the transport substrate. According to the present invention, the average value of the transport voltage is set between the potential of the image portions and the non-image portions. However, it has been stated that the toner is directed towards the latent image carrying member at the image portions, and the toner is directed in the opposite direction to the latent image carrying member at the non-image portions. This condition was examined in detail. From the results it was found that whether hopping toner adhered to the latent image carrying member or not depended on the amount of charge, the density, and the hopping height. What is important here is the potential on the hopping toner (substrate) side. The potential of the transport substrate varies depending on the circumstances of the hopping toner, and by understanding the potential on the surface of the substrate, it can be determined whether or not toner will adhere on the latent image carrying member. In other words, if the potential on the latent image carrying member side is high, toner having negative polarity will adhere to the latent image carrying member. If the potential on the latent image carrying member side is low, toner having negative polarity will not adhere to the latent image carrying member.

Specifically, a wave form that switches between −100 V and 0 V such as the driving pattern shown in FIG. 13 was applied to the transport electrodes to cause toner carrying, and latent images were developed. The potential on the latent image carrying member was −100 V in the non-image portions, and −20 V in the image portions, and developing was carried out using the toner hopping on the transport substrate. Toner adhered to the image portions of the latent image carrying member, and toner did not adhere to the non-image portions of the latent image carrying member, so good development was obtained. The conditions on the latent image carrying member side were fixed, and the limit for reproduction of good images was investigated by offsetting the voltage pattern applied to the transport electrodes with a DC bias. The results showed that when the offset was −30 V, toner adhered to the non-image portions. At this time the potential on the transport substrate was around −90 V to −100 V. Also, when offset with a positive DC bias, when the potential on the transport substrate was about −20 V, there were parts where the toner did not adhere. From the results it can be seen that when the potential of the transport substrate is set to between the potential of the image portions and the non-image portions of the latent image carrying member, toner adheres to the image portions, toner does not adhere to the non-image portions, and good developing can be obtained.

At this time, the attraction force on the hopping toner from the image portions of the latent image is the force from the electric field which depends on the potential difference between the substrate side and the latent image side. The potential of the toner layer is determined by the density, charge, and hopping height of the toner hopping on the transport electrodes. When the toner density is low, the charge is small, and the hopping height is low, the potential of the toner layer becomes lower, and reaches a negligible level.

In this way, in ETH developing, the hopping toner is attracted to and adheres to the image portions of the latent image. At the non-image portions the toner is repelled and does not adhere. Therefore, the latent images can be developed by the toner. At this time, an attraction force is not generated between the toner that is already hopping and the transport substrate 11, so the toner can be easily carried towards the latent image carrying member. Therefore developing that can provide high quality images can be carried out at low voltage.

In other words, in the conventional so-called jumping developing method, to separate the charged toner from the developing roller and transfer it to the photosensitive member it was necessary to apply a voltage that was equal to or greater than the adhesion force of the toner to the developing roller, or a DC bias voltage between 600 and 900 V was necessary. In contrast to this, according to the present invention the adhesion force of the toner is normally between 50 to 200 nN. However, the toner is hopping on the transport substrate 11, so the attraction force to the transport substrate 11 is approximately zero. Therefore it is not necessary to provide a force to separate the toner from the transport substrate 11, and it is possible to transfer sufficient toner to the latent image carrying member side with a low voltage.

Moreover, although the absolute value of the voltage applied between each transport electrode 102 is a low voltage in the range 100 to 150 V or less, the electric fields are very large values. Therefore toner adhering to the surface of the transport electrodes 102 can be easily separated, so hopping is possible. Also, the amount of ozone and NOx generated when charging a photosensitive member such as an OPC is very small or zero, which is very beneficial regarding environmental problems and durability of the photosensitive member.

Therefore, high bias voltages such as the 500 V to several kV applied between the developing roller and the photosensitive member in order to separate the toner adhering to the surface of the developing roller or the surface of a carrier in the conventional method is not necessary. Therefore it is possible to form latent images and develop them with extremely low values of charging potential on the photosensitive member.

The average value of potential (average direct potential) applied to the electrodes of the transport substrate referred to here is the direct potential on the transport substrate averaged over time and space. As stated previously, a potential that varies periodically is applied to the electrode pattern of the transport substrate. However, at the surface of the latent image carrying member of a developing unit which is a certain distance from the transport substrate, this becomes the average potential. If the duty of the drive voltage pattern is 50%, the avera ge value of potential is the average value of the high level voltage and the low level voltage of the driving pattern. Therefore, this average voltage value to which is added the effect of the potential of the toner layer becomes the surface voltage of the transport substrate. The surface voltage of the transport substrate is set between the potential of the image portions and the non-image portions of the latent images on the latent image carrying member, so high quality developing is possible.

Furthermore, using this developing method, it is possible to efficiently obtain high quality images when forming color images also, compared with the conventional method. In other words, in ETH development, by making the toner hop, the toner is attracted to and adheres to the image portions of the latent images, and the toner is repelled from and does not adhere to the non-image portions. Therefore, the toner faithfully adheres to the latent image electric field on the photosensitive member. At this time, there is no force of attraction between the toner that is already hopping and the transport substrate. Therefore, it is not necessary to separate the toner from the toner carrying member with a large force as was necessary with the conventional developing method. It is possible to easily transfer the toner to the latent image carrying member side, and good quality developing at low voltage is possible. In the conventional developing method, a large force is required to separate the toner from the toner carrying member. Therefore there can be a problem when for example forming a further toner image onto a toner image, that the existing toner image can be disturbed. In ETH development, existing toner images are not disturbed, and toner images can be formed from latent images.

Therefore, for the second and subsequent colors, as stated above, by providing means to form an electric field such that in the developing area the toner in the color to be developed adheres to the image portions of the latent image, and does not adhere to the non-image portions of the latent image carrying member, toner already existing on the photosensitive member is not disturbed, and good developing is possible.

Next, superimposing toner in several colors onto the photosensitive member to obtain an image is explained using an example.

The first toner can be considered to be the same as the single color case. Consider the case of a pulse shaped voltage wave form that varies between 0 and −100 V as shown in the hopping voltage pattern of the drive wave form of FIG. 13. When the potential of the non-image portions of the latent image was −150 or −170 V, toner did not adhere to the non-image portions. When the potential of the image portions was −20 V, it was confirmed that the toner was attracted towards the image portions of the latent image carrying member. At this time the potential on the transport substrate was measured to be −70 V to −80 V.

Next, a second toner image was formed on the latent image carrying member on which a toner image was already formed. The hopping voltage pattern of the second toner was set to a pulse shaped voltage wave form varying between −50 to −150 V. When the potential of the non-image portions of the latent image were −200 V or −220 V, the toner did not adhere to the non-image portions of the latent image carrying member. It was confirmed that the toner did adhere to the image portions of the latent image carrying member. Also, the potential of the image portions of the latent image with respect to the second image was −50 V, but in this case the toner adhered to the image portions of the latent image forming member. At this time the potential on the transport substrate was between −110 V and −120 V.

Similar to when developing a single color only, when the potential on the transport substrate is set to a value between the potential of the image portions and the non-image portions, the toner can selectively adhere to the image portions of the latent image carrying member, and good developing can be obtained. If there is already toner adhering to the image portions of the latent image carrying member that is to be developed, by setting the potential on the transport substrate to a value between the potential of these image portions and the non-image portions, toner will adhere to the image portions of the latent image carrying member, and will not adhere to the non-image portions of the latent image carrying member. If there is already toner adhering to the image portions of the latent image carrying member that is to be developed, and if the polarity of the charge on the toner already adhering to the latent image carrying member is negative, the potential of the image portions will be reduced on account of this charge. If the potential on the transport substrate is set to a value between the reduced potential of these image portions and the non-image portions, toner will selectively adhere to the image portions of the latent image carrying member. If the toner already adhering to the latent image carrying member retains the charge from the time that that toner was developed, and if the polarity of the toner is negative, the potential of the image portions is reduced by that charge. If the potential on the transport substrate is set to a value between the reduced potential of these image portions and the non-image portions, toner will selectively adhere to the image portions of the latent image carrying member.

If the toner that is already adhering to the latent image carrying member becomes charged subsequent to adhering to the latent image carrying member, either through charging or exposure to light, and if the polarity of the charge on the toner is negative, the potential of the image portion is reduced by that charge. If the potential on the transport substrate is set to a value between the reduced potential of these image portions and the non-image portions, toner will selectively adhere to the image portions of the latent image carrying member.

Figure 17:
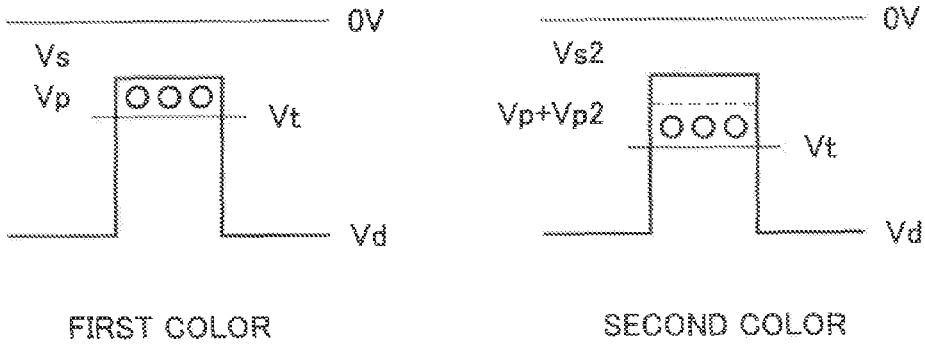
FIG. 17 is a diagram showing the potential of toner adhering to the photosensitive member.

The following is an explanation of the potential of the toner layer on the image portions for the case that toner is already adhering to the image portion that is to be developed, as described above. FIG. 17 is a diagram showing the potential of the toner adhering to the photosensitive member. The potential of the non-image portions is −Vd, the potential of the image portions of the latent images is Vs, and the potential of the image portion where toner is adhering is Vt. Vt includes both the potential of the latent image Vs and the potential Vp of the toner itself. Next, to apply the toner of the second color, if the toner layer is charged and exposed to light when forming the latent image, the potential of the toner layer becomes the potential of the image portion of the latent image Vs2 plus the potential of the toner layer Vp plus the potential applied to the toner by the charge Vp2. In a process in which charging is not carried out before developing the second toner layer, the Vp2 due to charge does not act. Also, in a process in which the toner on the photosensitive member is decharged prior to forming the latent image for the second color, Vp may be ignored when developing the second color.

EXAMPLE 1

A test was carried out to form a two color toner image on a photosensitive member. The photosensitive member was a 60 mm diameter drum. The photosensitive drum was uniformly charged by a scorotron charger. Then, by irradiating with laser light in accordance with a pattern, an electrostatic latent image was formed on the photosensitive member. This electrostatic latent image was developed by selectively applying toner using the ETH development method according to the present invention. In the test, the process from uniformly charging the photosensitive member to applying toner was repeated twice, and a two color image was formed on the photosensitive member. In an actual system a four color image is normally formed, but a multi-color image is formed on the photosensitive member by repeating the process by the number of toner colors. Then the image is transferred to a transfer medium and fixed to obtain the image. In this test, after forming the two color toner image, the image on the photosensitive member was evaluated. The first color was cyan, and the second color was magenta. The average charge of the toner was −20 μC/g for both colors.

First, the photosensitive member was uniformly charged to about −150 V, and irradiated with laser light for the cyan pattern. The part of the photosensitive member irradiated with laser light was the image portion. A latent image was formed of about −35 V in the image portions, and −150 V in the non-image portions. Transport electrodes for developing as shown in FIG. 2 were used. The drive voltage pulse was a three phase pattern, frequency 5 kHz, duty 50% as shown in FIG. 13, with a high value voltage of −20 V, and a low value voltage of −120 V. The potential of the image portion after developing was about −70 V, and the potential of the non-image portion was about −140 V. At this time the potential on the transport substrate was between −80 V and −90 V. Under these conditions the photosensitive member on which daylight cyan toner was adhering was removed. It was observed that toner was adhering to the image portions, and was not adhering to the non-image portions. At this time the potential of the image portions was about −35 V, and potential of the non-image portions was about 0 V. In daylight the potential of the photosensitive member became almost zero. The potential of −35 V measured in the image portions is thought to be the potential due to the charge on the toner.

Next, a two color superposition test was carried out. After a cyan toner image was formed on the photosensitive member as described above, the photosensitive member was again charged with the scorotron charger. Charging was carried out so that the potential of the photosensitive member was about −300 V after charging. The pattern for the second color magenta was superimposed on the cyan toner image with a laser. After forming, the potential of the image portion was about −95 V, and the potential of the non-image portions was about −300 V. The drive voltage for developing the second color was the same as that for the first color, with a high level voltage of −70 V and a low level voltage of −170 V. After developing, the photosensitive member was removed and checked. The magenta layer was adhering above the cyan layer, and adhesion of toner in the non-image areas was not seen. At this time, the potential of the transport substrate was between −130 V and −140 V. After removal into daylight, the potential of the image portions was about −80 V, about −45 V lower compared with the toner layer potential measured after developing the first color. This is considered to be due to the potential of the charge on the toner of the second color and the charging of the toner of the first color prior to the second color toner image forming operation.

At this time, for comparison developing was attempted with the second color high level and low level drive voltage the same as for the first color. However, magenta toner did not adhere to the image portions. This is considered to be because in this case the potential on the transport substrate was in the range −80 V to −90 V, which was not between the potential of the non-image portions and image portions of the second color image.

EXAMPLE 2

A toner image in the first color was formed in the same way as in Example 1. Then the photosensitive member to which the toner was adhering was decharged with an AC scorotron charger. The potential on the photosensitive member including the toner layer became virtually 0 V. Then, the magenta toner was applied over the cyan toner. After decharging the photosensitive member was uniformly charged to −300 V, the laser irradiated over the cyan toner to form the image pattern for developing the magenta. At this time the potential of the image portions was about −60 V. This −60 V is considered to be the potential due to electrostatic charge and the potential at the image portions of the photosensitive member, due to the charging the first color cyan toner prior to developing the second color. In this case as well, development for the second color was performed under the same condition as that for the Example 1.

In this way, by carrying out decharging, the change in potential of the toner layers due to superimposition can be made small, and the developing drive voltage can be kept low when forming multi-color images.

Also, when forming a solid toner image on the photosensitive member in the first color and further forming a toner image in the second color, the method of forming a latent image for the second color by charging the photosensitive member, to which the toner in the first color is adhering, in order to form the image was carried out. The potential of the latent image on the toner image in the first color was about −70 V, so developing was carried out with the potential of the transport electrodes adjusted to −120 V. At this time, the potential of the non-image portion was −180 V, so the average value of the transport drive voltage was set to a value between the potential of the image portions and the non-image portions, so good developing was carried out. Under the same conditions image forming in the first color was carried out, and the toner in the first color on the photosensitive member was decharged with an AC charger installed near the photosensitive member. Then, charging and exposure to light to form the latent image for the second color was carried out. The potential of the image portions on the toner layer of the first color was about −40 V, and the potential of the non-image portions was −180 V. Developing was carried out with the potential on the transport electrodes at −120 V, and good images were obtained.

Figure 18A:
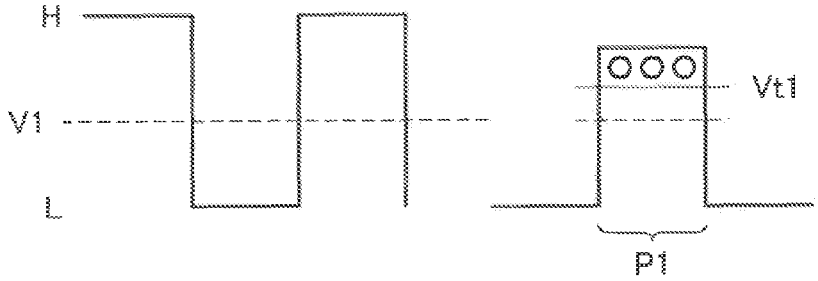
FIGS. 18A and 18B are diagrams showing the relationship between the hopping voltage and the potential of the image portions, and the potential of the non-image portions, between a plurality of developing operations.
Figure 18B:
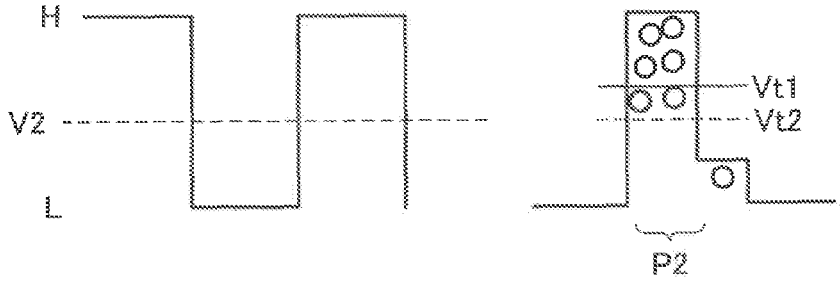

The relationship between the hopping voltage over a plurality of developing operations, the potential of the image portions, and the potential of the non-image portions in setting the potential on the transport electrodes to a value between the potential of the image portions and non-image portions of the photosensitive member in this way, and directing the toner towards the image portions of the latent image carrying member and not directing the toner to the non-image portions, is explained with reference to FIGS. 18A and 18B. This figure shows the case where toner in a plurality of colors is applied to a single photosensitive member. FIG. 18A is the case for the first color, and FIG. 18B is the case for the second color. First, the transport drive voltage applied to the transport substrate used in developing the toner of the first color had a duty of 50%. At this time the potential on the transport substrate is V1. Corresponding to this, the relationship to the potential of the non-image portions and image portions of the image pattern P1 for the first color formed on the latent image carrying member is as shown in FIG. 18. In FIGS. 18A and 18D it is assumed that the toner is negatively charged, so the higher the potential in the upward direction in the figures the more the toner will adhere. Therefore, when this type of potential relationship is established, with V1 set to a value between the potential of the image portions and the non-image portions, good developing can be carried out. When adhesion of toner onto the image portions is finished, the potential of the toner layer Vt1 is not less than V1. Therefore the lower limit for Vt1 is V1.

The case where toner in the second color is further applied over this toner layer is considered in FIG. 18B. The image width of the second color is P2. To apply further toner on P2, it is necessary that the potential V2 on the transport substrate used in developing the second color is a value smaller than Vt1. Also, the potential Vt2 after developing the toner of the second color must not be less than V2. Therefore, the lower limit for Vt2 is V2.

By repeating this type of relationship, it is possible to superimpose toner in a plurality of colors onto toner. In other words, if the potential on the transport substrate used in developing the $m^{th}$ time (where m is a positive integer) is $V_m$, if $V_m > V_{m+1}$ then good toner superimposition developing is possible.

Specifically, the high level voltage and the low level voltage of the drive voltage pulse applied to the transport substrate used in developing the first color were −50 V and −150 V respectively. Developing was carried out. At this time the potential on the transport substrate was about −120 V. The latent image potential was −170 V in the non-image portions and about −80 V in the image portions. It was confirmed that good adhesion of the toner was obtained. In order to apply the toner in the second color, the high level and low level voltages of the drive voltage pulse was −70 V and −170 V respectively. The potential on the transport substrate was about −150 V. The potential of the image portions of the toner in the second color was about −100 V, and the potential in the non-image portions was −190 V. At this time it was confirmed that good adhesion of the toner in the second color onto the toner in the first color was obtained.

Instead of applying the pulse voltage in this way, the exact same result can be easily obtained by the method of generating a pulse voltage of ±50 V, and applying DC components of −100 V and −120 V respectively.

Figure 19:
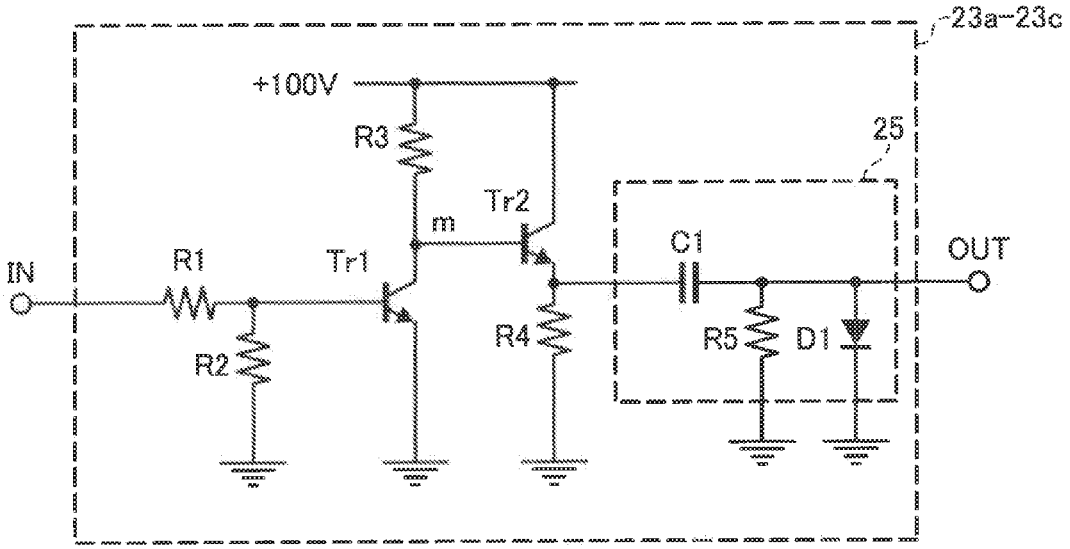
FIG. 19 is a circuit diagram showing an example of the structure of the wave form amplifier of FIG. 10.

Here an example of the wave form amplifiers 23*a* through 23*c* for generating the drive wave form for the hopping voltage pattern shown in FIG. 13 is explained with reference to FIG. 19.

The drive wave form for the hopping voltage pattern described previously in connection with FIG. 13 is a pulse wave form in which each phase varies between 0 and −100 V, and the duty with the potential relatively in the + time (0 V time) is 67%. However, here a wave form is explained in which the duty when the potential is relatively in the + time (0 V time) is 33%.

The wave form amplifiers 23*a* through 23*c* include resistors R1, R2 to divide the input signal, a transistor Tr1 for switching, a collector resistor R3, a transistor Tr2, a current limiting resistor R4, and a clamp circuit 25 constructed from a condenser C1, a resistor R5, and a diode D1.

Figure 20A:
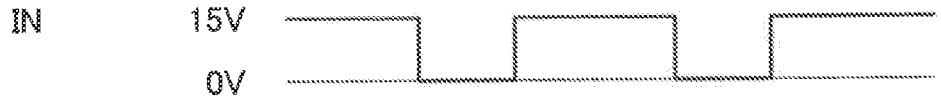
FIG. 20A through 20C are diagrams showing the signal wave form from the pulse signal generation circuit of FIG. 10.
Figure 20B:
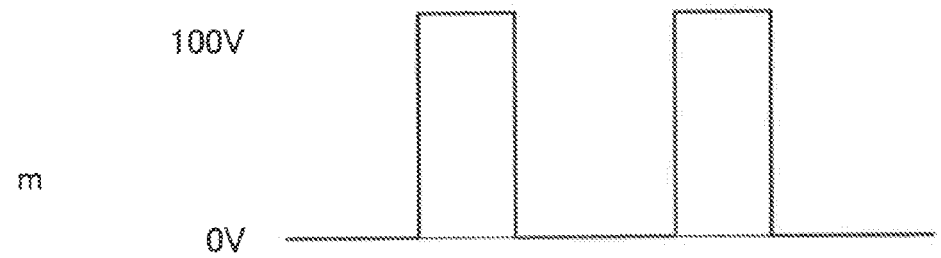

When, as shown in FIG. 20A, an input signal IN, having for example a wave form that varies from 0 to 15 V as shown in the figure and the duty at 15 V is 67%, is applied to the wave form amplifiers 22*a* through 22*c* from the pulse signal generation circuit 21, the input signal IN is voltage divided by the resistors R1, R2, and input to the base of the transistor Tr1. By switching the transistor Tr1, the phase is inverted, and a voltage wave form (collector voltage) m with level raised to between 0 and +100 V is obtained as shown in FIG. 20B.

Figure 20C:
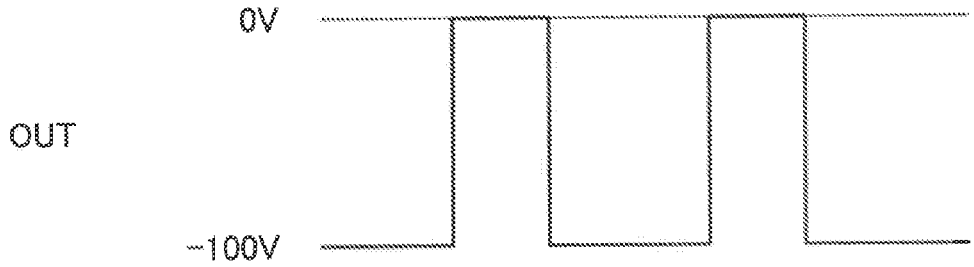

The transistor Tr2 receives the collector voltage m, and outputs a wave form at the same level with low impedance. The clamp circuit 25 connected to the emitter of the transistor Tr2 has a small time constant with respect to the + wave form, and the time constant with respect to the − wave form is determined by the condenser C1 and the resistor R5. However, by setting the time constant to a sufficiently high value with respect to the pulse frequency, the output wave form OUT which varies from 0 to −100 V with the zero level clamped is obtained from the clamp circuit 25, as shown in FIG. 20C.

Figure 21:
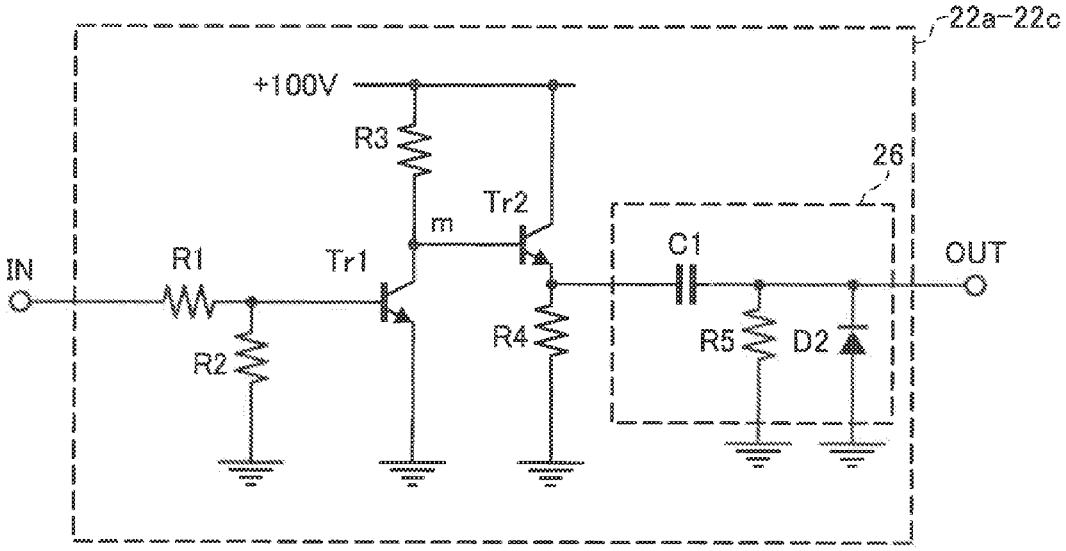
FIG. 21 is a circuit diagram showing an example of the structure of the wave form amplifier of FIG. 10.

Next, an example of the wave form amplifiers 22*a* through 22*c* that generate the drive wave form for the collecting transport voltage pattern shown in FIG. 11 is explained with reference to FIG. 21.

As stated previously, the collecting and transport voltage pattern drive wave form shown in FIG. 11 is an example of pulse wave form with each phase varying between 0 and +100 V. The duty when the potential is relatively in the + time (the time in +100 V) is 33%.

The wave form amplifiers 22*a* through 22*c* include resistors R1, R2 to divide the input signal, a transistor Tr1 for switching, a collector resistor R3, a transistor Tr2, a current limiting resistor R4, and a clamp circuit 26 constructed from a condenser C1, a resistor R5, and a diode D2. In other words, the only difference is the orientation of the diode D1 of the clamp circuit 25 of the wave form amplifiers 23*a* through 23*c* and the orientation of the diode D2 of the clamp circuit 26 of the wave form amplifiers 22*a* through 22*c*.

Figure 22A:
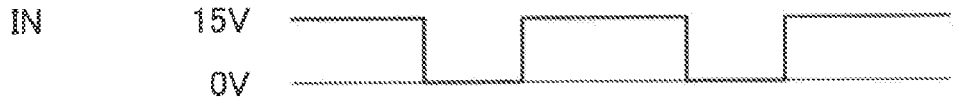
FIGS. 22A through 22C are diagrams showing the signal wave form from the pulse signal generation circuit of FIG. 10.
Figure 22B:
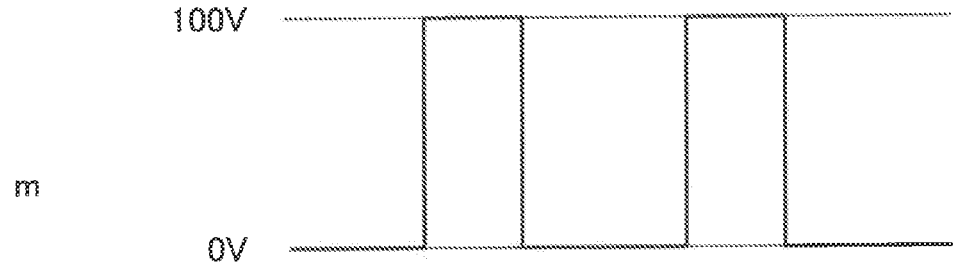

When, as shown in FIG. 22A, an input signal IN, having for example a wave form that varies from 0 to 15 V and the duty at 15 V is 67% as shown in the figure, is applied to the wave form amplifiers 23*a* through 23*c* from the pulse signal generation circuit 21, the input signal IN is voltage divided by the resistors R1, R2, and input to the base of the transistor Tr1. By switching the transistor Tr1, the phase is inverted, and a voltage wave form (collector voltage) m with level raised to between 0 and +100 V is obtained as shown in FIG. 22B.

Figure 22C:
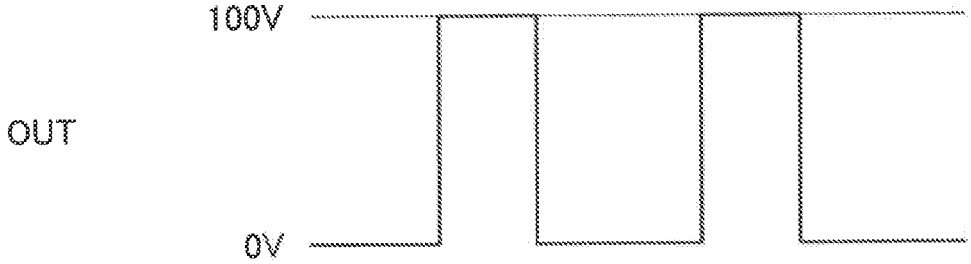

The transistor Tr2 receives the collector voltage m, and outputs a wave form at the same level with low impedance. The clamp circuit 26 connected to the emitter of the transistor Tr2 has a small time constant with respect to the − wave form, and the time constant with respect to the + wave form is determined by the condenser C1 and the resistor R5. However, by setting the time constant to a sufficiently high value with respect to the pulse frequency, the output wave form OUT which varies from 0 to +100 V with the zero level clamped is obtained from the clamp circuit 26, as shown in FIG. 22C.

In this way the drive wave form applied to each electrode in the transport substrate is formed by the clamp circuit constructed from the condenser, the resistor, and the diode. Therefore a stable wave form can be obtained from a simple circuit construction, for which the low level side is clamped so there is no drift, and for which the wave high value is fixed. Therefore accurate carrying and hopping of toner is possible.

Here the relationship between the toner charge polarity and the voltage (potential) applied to the electrodes 102 of the transport substrate 11 is explained. If negatively charged toner is used, in the developing area the voltage is between 0 and −V1, and in the area after passing the developing area the voltage is between 0 and +V2. In other words, the voltage of the hopping drive wave form varies between 0 to −V, and the voltage of the collecting and carrying drive wave form varies between 0 and +V, so the structure of the drive circuit as described above is simple, and the reliability is improved.

In the same way, if positively charged toner is used, in the developing area the voltage is between 0 and +V3, and in the area after passing the developing area the voltage is between 0 and −V4. In other words, the voltage of the hopping drive wave form is varied between 0 to +V, and the voltage of the collecting and carrying drive wave form varies between 0 and −V, so the structure of the drive circuit as described above is simple, and the reliability is improved.

The above voltages V1, V2, V3, V4 may have the same absolute value, or they may have different absolute values.

Figure 23:
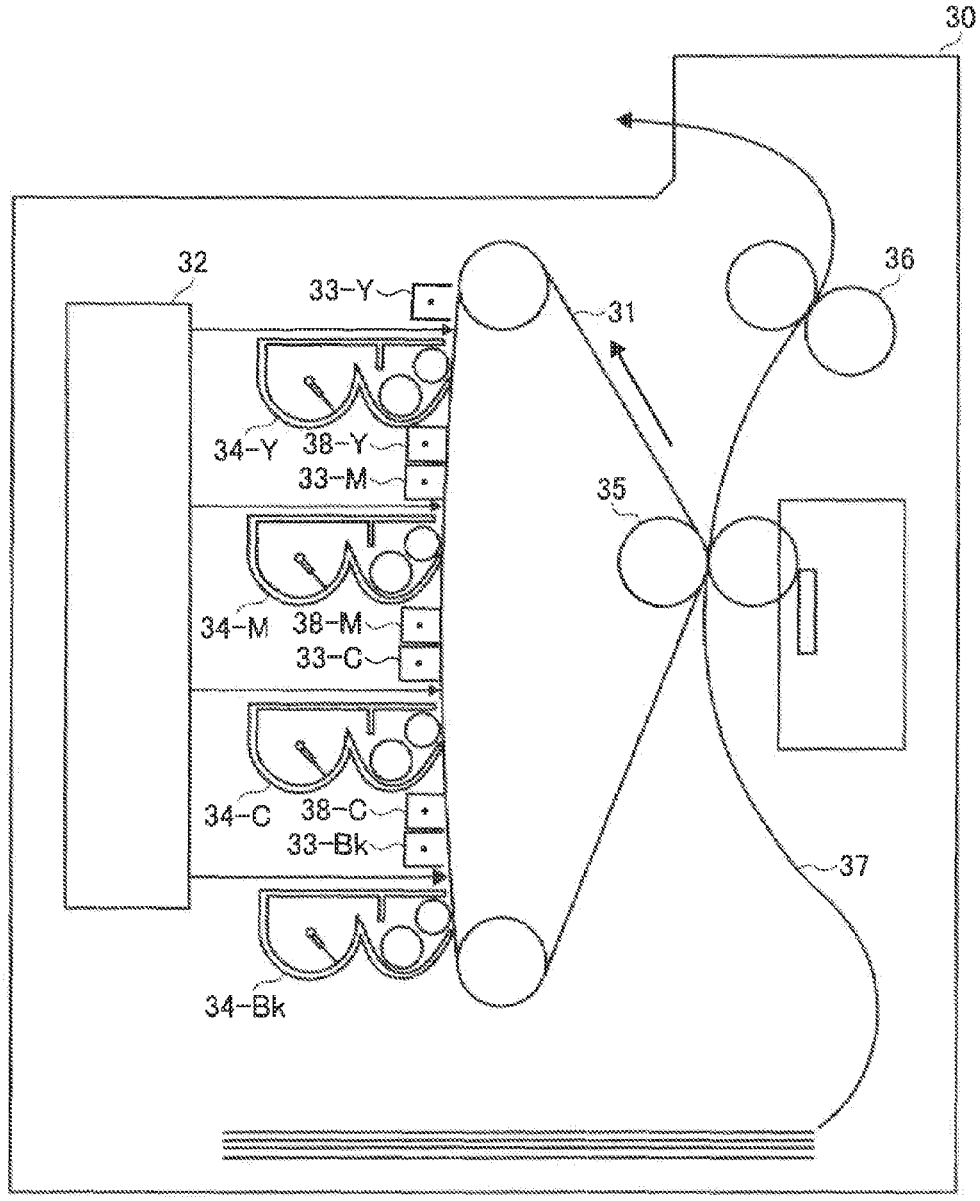
FIG. 23 is a diagram showing an example of the structure of an image forming apparatus that uses the developing device.

FIG. 23 is a diagram showing an example of the structure of an image forming apparatus that uses the developing device according to the present invention. The image forming apparatus 30 shown in this figure includes a photosensitive belt 31, a laser writing device 32, a scorotron charger 33 that charges the photosensitive belt 31 to a predetermined voltage, a developing device 34 that applies toner to electrostatic latent images on the photosensitive belt 31, a transfer unit 35 that transfers images on the photosensitive belt 31 onto transfer sheets, and a fixing unit 36 that fixes the toner on the transfer sheets. Also, the developing device 34 includes a voltage measurement device (which is not shown on the drawings) to measure the surface potential on the transport substrate. Further, the scorotron charger 33 and the developing device 34 are provided for each color. Also, the photosensitive belt 31 rotates in the direction of the arrow shown in the figure.

Next, the operation when the image forming apparatus 30 shown in FIG. 23 is operated is explained.

First, the photosensitive belt 31 is uniformly charged by the scorotron charger 33-Y. An electrostatic latent image is formed on the photosensitive belt 31 in respect of the yellow data by selectively irradiating with laser light from the writing device 32. Yellow toner is applied to this electrostatic latent image by the developing device 34-Y to form a yellow toner image on the photosensitive belt 31. The yellow toner image moves as the photosensitive belt 31 moves and is again uniformly charged by the scorotron charger 33-M. Laser scanning is carried out to form the electrostatic latent image corresponding to the magenta data. Then the magenta toner is developed using the developing device 34-M. In the same way, cyan and black toner images are applied to the photosensitive member, so that four color toner is applied to the photosensitive belt 31. This image is transferred onto transfer sheets by the transfer unit 35 and fixed by the fixing unit 36 to obtain color images.

In this way, color images can be formed in only one revolution of the photosensitive belt 31 using the developing device according to the present invention. Also, toner images are superimposed on the photosensitive belt 31 so an intermediate transfer member is not required, so the device can be made smaller. Also, the toner on the photosensitive belt 31 is not disturbed by the downstream developing or collected by the downstream developing device, so there is no mixing of colors, and good images can be obtained over time.

Figure 24:
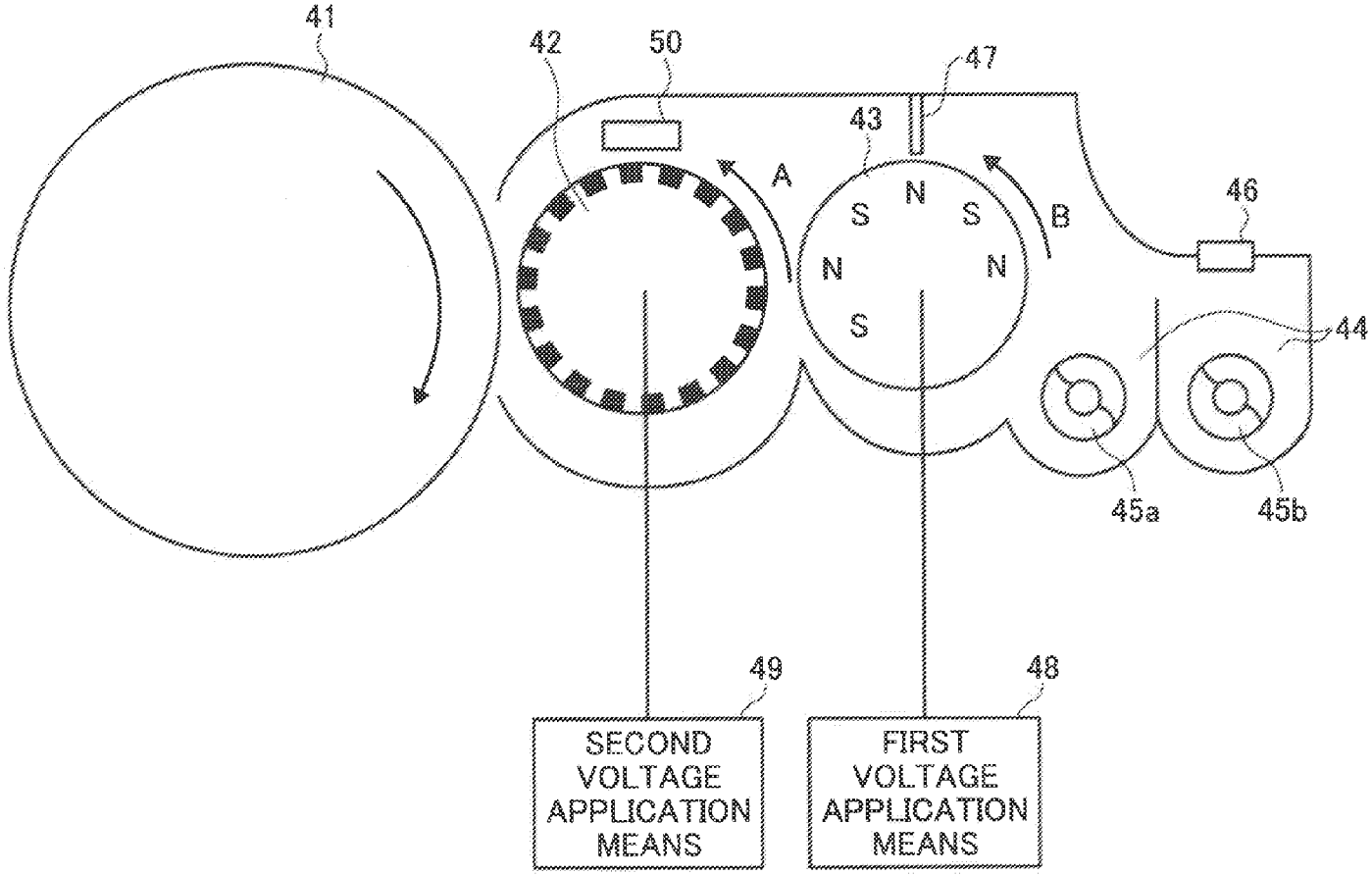
FIG. 24 is a diagram showing an example of the schematic structure of the developing device.

FIG. 24 shows an example of the schematic structure of a developing device according to the present embodiment. The developing device shown in this figure uses two part developer that includes magnetic carrier and non-magnetic toner. The developing device includes a latent image carrying member 41, a transport member 42 formed in a roller shape that transports toner to the area in opposition to the latent image carrying member 41, a developer carrying member 43, that is toner supply means, in opposition to the transport member 42 and that supplies toner to the transport member 42, and a developer housing unit 44 that houses the toner and magnetic carrier that is supplied to the developer carrying member 43. In this case the transport member 42 is disposed in opposition to the latent image carrying member 41 and the developer carrying member 43 at areas on opposite sides in the diametral direction.

The transport member 42 and the latent image carrying member 41 are in opposition without contact, with a gap of 50 to 1000 μm, preferably 150 to 400 μm between them. Also, the transport member 42 does not rotate, but toner is carried on the outer periphery in the direction of the arrow A by a transport electric field (phase electric field). On the other hand, the developer carrying member 43 rotates in the direction of the arrow B.

The developer housing unit 44 is divided into two compartments, and each compartment is connected by a developer path that is not shown on the drawings at both ends within the developing device. The developer housing unit 44 houses two part developer that is agitated and transported within the developer housing unit 44 by agitation and transport screws 45*a*, 45*b* in each compartment.

Also, a toner replenishment opening 46 is provided in the developer housing unit 44 to replenish the developer from a toner housing unit that is not shown in the drawings. Also, a toner concentration sensor (that is not shown in the drawings) that measures the magnetic permeability of the developer is provided in the developer housing unit 44, to measure the concentration of the developer. When the concentration of the toner in the developer housing unit 44 reduces, toner is supplied to the developer housing unit 44 through the toner replenishment opening 46.

Further, the developer carrying member 43 is disposed in an area in opposition to the agitation and transport screw 45*a* of the developer housing unit 44. Fixed magnets are disposed within the developer carrying member 43. Developer within the developer housing unit 44 is scooped up onto the surface of the developer carrying member 43 by the rotation and magnetic force of the developer carrying member 43.

Also, on the downstream side of the area where the developer is scooped up in the direction of rotation of the developer carrying member 43 (the direction of the arrow B) and on the upstream side of the area in opposition to the transport member 42, a developer layer regulating member 47 is provided in an area in opposition to the developer carrying member 43. The developer layer regulating member 47 regulates the developer that was scooped up at the scooping up area to a uniform developer layer thickness. Also, the developer that has passed the developer layer regulating member 47 is transported by the rotation of the developer carrying member 43 to the an area in opposition to the transport member 42.

Here, a supply bias is applied to the developer carrying member 43 by first voltage application means 48. Also, a voltage is applied to transport electrodes in the transport member 42 by second voltage application means 49.

In this way, an electric field is generated by the first voltage application means 48 and the second voltage application means 49 between the transport member 42 and the developer carrying member 43 in the area where the developer carrying member 43 is in opposition to the transport member 42. When the electrostatic force of the electric field acts on the toner, the toner is separated from the carrier, and is transferred to the surface of the transport member 42.

Next, the toner is transported by the transport electric field to an area in opposition to the latent image carrying member 41. There the toner is transferred onto the latent image carrying member 41 by the developing electric field between the transport member 42 and the latent image carrying member 41. The toner makes visible (develops) the latent image on the latent image carrying member 41. A surface potential measuring unit 50 that measures the surface potential of the transport member 42 is provided in opposition to the transport member 42. While the transport voltage is being applied to the electrodes of the transport member 42, the surface potential of the transport member 42 varies depending on the transport voltage and the toner being transported. By directly measuring the surface potential by the surface potential measuring unit 50, it is possible to accurately know the potential on the transport member 42.

Figure 25:
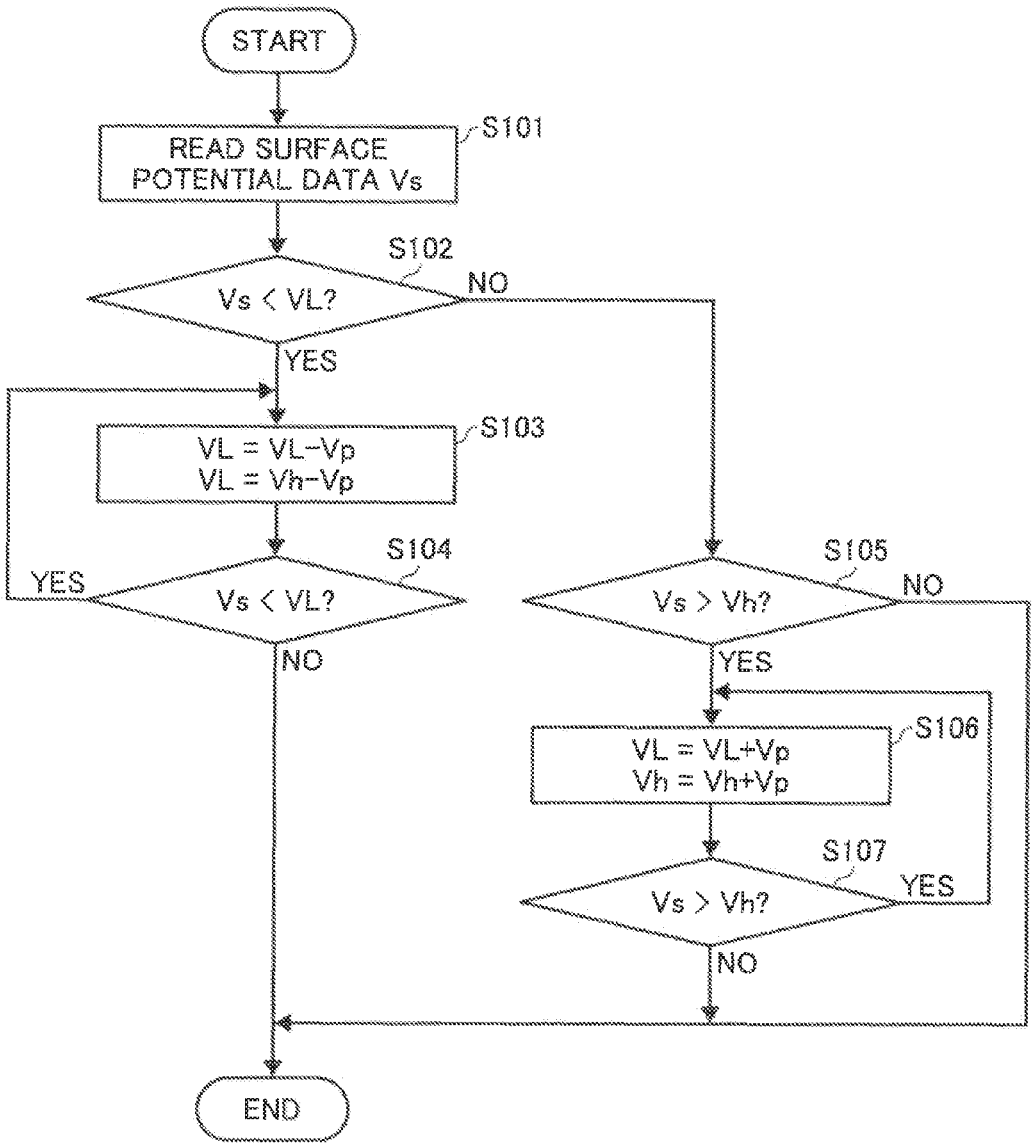
FIG. 25 is a flowchart showing an example of the procedure for setting the process conditions.

Next, the process condition that the surface potential on the transport member 42 is a value between the potential of the image portions and the non-image portions of the latent image carrying member 41 is set in accordance with the measured surface potential on the transport member 42. FIG. 25 is a flowchart showing an example of the setting procedure for the process condition. A three phase voltage that fluctuates between VL and Vh is applied to the transport electrodes on the transport member 42 in FIG. 24. Then, the surface potential data Vs from the surface potential measuring unit 50 in FIG. 24 on the transport member 42 is read (Step S101). If this Vs is smaller than VL, a predetermined value Vp is subtracted from VL and Vh (Step S102; YES, Step S103). VL and Vh move at the same time, so the transport voltage Vpp does not change. Conversely, if Vs is larger than VL, and Vs is larger than Vh, Vp is added to VL and Vh (Step S101; NO, Step S105; YES, Step S106). The operation is repeated until Vs is larger than VL (Step S104; NO) , or Vs is smaller than Vh (Step S107; NO). Specifically, if Vpp is set to a transport voltage in the form of DC superimposed on a fixed voltage, then the DC bias can be adjusted in accordance with the conditions so that Vs is between the potential of the image portions and the potential of the non-image portions of the latent image carrying member 41 shown in FIG. 24. With this type of operation, it is possible to appropriately set the potential on the transport member 42 by a simple method.

Figure 26:
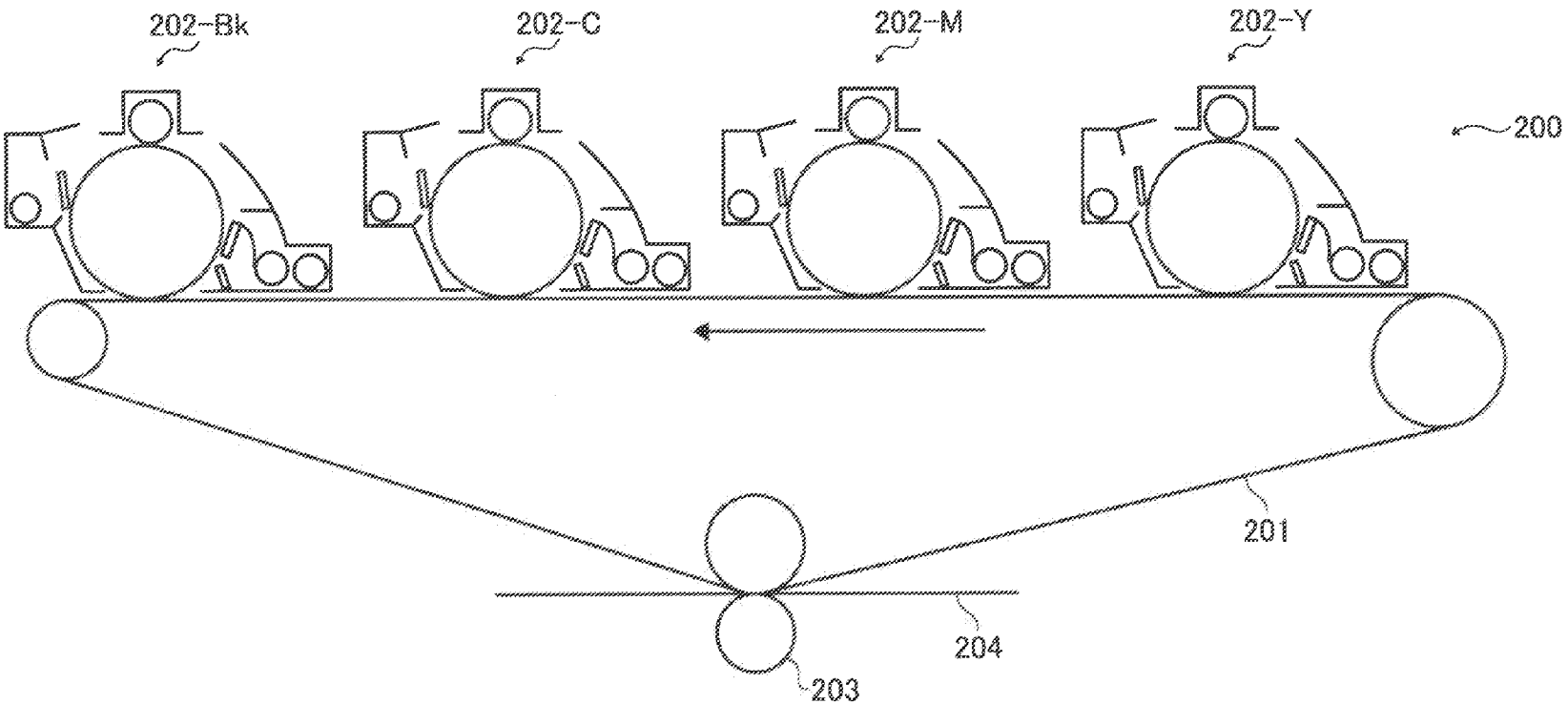
FIG. 26 is a diagram showing the schematic structure of an image forming apparatus provided with a process cartridge according to a separate invention.
Figure 27:
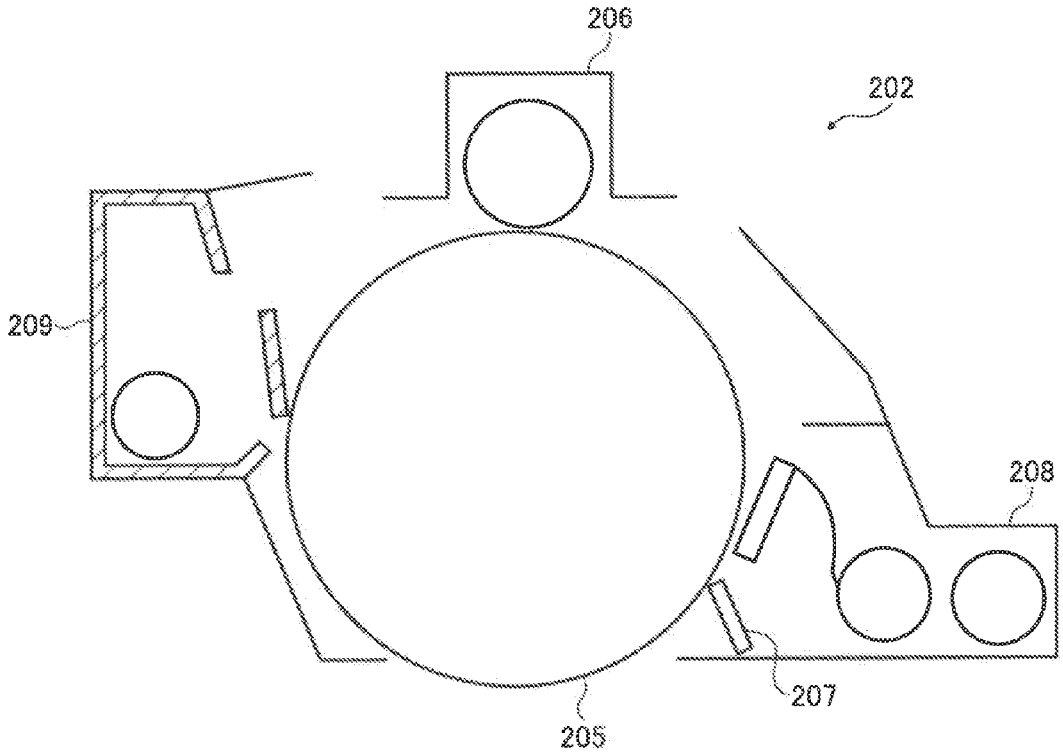
FIG. 27 is a diagram showing the schematic structure of the process cartridge in FIG. 26.

Next, an embodiment of an image forming apparatus provided with a process cartridge according to a separate invention is simply explained with reference to FIGS. 26 and 27. FIG. 26 is a diagram showing the schematic structure of an image forming apparatus provided with a process cartridge according to a separate invention. FIG. 27 is a diagram showing the schematic structure of the process cartridge.

An image forming apparatus 200 shown in FIG. 26 is a tandem type color image forming apparatus in which process cartridges in each color 202-Y, 202-M, 202-C, 202-Bk (hereafter referred to collectively as the process cartridges 202) are disposed in a line along a transfer belt (latent image carrying member) 201 that extends horizontally. The process cartridges 202 were explained in the order yellow, magenta, cyan, and black. However, this order is not mandatory, and any order may be used.

The process cartridge 202 shown in FIG. 27 includes a latent image carrying member 205, charging means 206, a developing device 208 according to the present invention that includes a transport substrate 207, a cleaning device 209, and other elements. The elements are connected integrally to form a plurality of process cartridges. The process cartridges 202 can be freely inserted into and removed from an image forming apparatus such as a photocopier or a printer.

Normally color image forming apparatuses have a plurality of image forming units, so the device becomes large. Also, in each unit the developing device, the cleaning device, the charging device, and so on can separately break down, and when the replacement time comes a lot of time is required for replacing units because of the complexity of the device.

Therefore by connecting at least the latent image carrying member and the developing device integrally to form a process cartridge 202, it is possible to provide a small-sized high durability image forming apparatus for which even a user can change process cartridges 202.

Here, as shown in FIG. 26, the developed toner on latent image carrying members 205 developed in the process cartridges for each color 202-Y, 202-M, 202-C, 202-Bk, is transferred in turn onto the transfer belt 201 that extends in the horizontal direction and to which a transfer voltage is applied.

In this way, yellow, magenta, cyan, and black images are formed, and transferred in superposition onto the transfer belt 201. At transfer means 203 the image is transferred in one operation onto a transfer medium 204. Then the superimposed toner image on the transfer medium 204 is fixed in a fixing device that is not shown in the drawings.

Each of the embodiments of an image forming apparatus described above include a developing device according to the present invention. Therefore the device can be made smaller, the cost can be reduced, dispersal of toner can be eliminated, and image quality can be improved.

In the embodiments as described above, toner in powder form was used in the explanation. However, the present invention may also be applied to devices for transporting powders other than toner. Also, the drive signal applied to the transport electrodes was explained using the example of a three phase drive signal. However, the number of phases may be 4, 6, or n phases (where n is a positive integer equal to or greater than two). Further, by making the transport substrate in a cylindrical or belt form, transport on the surface of the transport substrate is possible, the toner collection efficiency can be improved, the device can be made smaller, and the usage efficiency improved.

As explained above, the voltage supply means of the developing device according to the present invention has the characteristic that an n phase voltage is applied to the transport electrodes so that the surface potential on the transport member is between the potential of the image portions and the potential of the non-image portions of the latent image carrying member. Therefore, powder securely adheres to the image portions of the latent image carrying member, and adherence of powder to the non-image portions is reduced. Therefore it is possible to obtain good images and dispersal of powder is prevented.

According to the present invention, the following effects can be obtained.

(1) It is possible to obtain good images with powder securely adhering to the image portions of the latent image carrying member, and adherence of powder to the non-image portions is reduced.

(2) Even when powder in many colors is superimposed, it is possible to obtain good images with powder securely adhering to the image portions of the latent image carrying member, and adherence of powder to the non-image portions is reduced.

(3) When developing the powder for the second and subsequent colors, good multi-color images can be obtained even if the potential of the image portions of the latent image carrying member is reduced by the charge of the previously developed powder.

(4) When developing the powder for the second and subsequent colors, good multi-color images can be obtained even if the charge on the previously developed powder is increased by charging carried out prior to writing the latent image.

(5) When developing the powder for the second and subsequent colors, good multi-color images can be obtained even if the potential of the image portions of the latent image carrying member is reduced by the charge of the previously developed powder and the charge on the previously developed powder that is increased by charging carried out prior to writing the latent image.

(6) Powder can be easily transported, so good multi-color images can be obtained.

(7) It is possible to provide process cartridges for which it is possible to obtain good images with powder securely adhering to the image portions of the latent image carrying member, and adherence of powder to the non-image portions is reduced.

Various modifications will become possible for those skilled in the art after receiving the teachings of the present disclosure without departing from the scope thereof.

What is claimed is:

1. A developing device for applying powder to a latent image carrying member to develop latent images on the latent image carrying member, comprising:

a transport member disposed in opposition to the latent image carrying member, and having a plurality of transport electrodes for generating electric fields to transport powder;

voltage supply means for applying n phase (where n is a positive integer equal to or greater than 2) voltage to the transport electrodes; and transport member surface potential determination means for determining the surface potential of the transport member, wherein the voltage supply means applies the n phase voltage to the transport electrodes so that the surface potential on the transport member is between the potential of the image portions and the potential of the non-image portions of the latent image carrying member, and when developing the powder for a second and subsequent colors, the voltage supply means applies the n phase voltage to the transport electrodes so that the surface potential on the transport member is between the potential of the image portions that has been reduced by the charge of the previously developed powder and the potential of the non-image portions of the latent image carrying member, and wherein latent image forming and developing are repeated to successively develop powder in different colors that are superimposed on the same latent image carrying member.

2. The developing device as claimed in claim 1, wherein when the latent image forming and developing are repeated to successively develop powder in the different colors on the same latent image carrying member, the voltage supply means applies the n phase voltage to the transport electrodes so that the surface potential on the transport member is between the potential of the image portions and the potential of the non-image portions of the latent image carrying member in respect of the powder of each color.

3. The developing device as claimed in claim 1, wherein when developing the powder for the second and subsequent colors, the voltage supply means applies the n phase voltage to the transport electrodes so that the surface potential on the transport member is between the potential of the image portions, for which the charge on the previously developed powder has been increased by charging that is carried out prior to writing the latent image, and the potential of the non-image portions, of the latent image carrying member.

4. The developing device as claimed in claim 1, wherein when developing the powder for the second and subsequent colors, the voltage supply means applies the n phase voltage to the transport electrodes so that the surface potential on the transport member is between the potential of the image portions that has been reduced by the charge of the previously developed powder and the charge on the powder that has been increased by charging that is carried out prior to writing the latent image, and the potential of the non-image portions of the latent image carrying member.

5. The developing device as claimed in claim 1, wherein the electric field that moves the powder is a progressive wave electric field.

6. The developing device as claimed in claim 1, wherein the wave form of the voltage applied to the electrodes of the transport member is a wave form obtained by superimposing a direct current bias onto a pulse voltage.

7. The developing device as claimed in claim 1, wherein surface potential V on the transport member, when the surface potential V on the $m^{th}$ time (where m is a positive integer) in an order that powder is applied to the latent image carrying member is $V_m$, satisfies $V_m > V_{m+1}$.

8. A process cartridge which has at least a developing device for developing latent images on a latent image carrying member by applying powder to the latent image carrying member, and which can be freely inserted into and removed from a main body of an image forming apparatus, the process cartridge comprising:

a transport member disposed in opposition to the latent image carrying member and having a plurality of transport electrodes that generate electric fields to transport powder;

voltage supply means for applying n phase (where n is a positive integer equal to or greater than 2) voltage to the transport electrodes; and transport member surface potential determination means for determining the surface potential of the transport member, wherein the voltage supply means applies the n phase voltage to the transport electrodes so that the surface potential on the transport member is between the potential of the image portions and the potential of the non-image portions of the latent image carrying member, and when developing the powder for a second and subsequent colors, the voltage supply means applies the n phase voltage to the transport electrodes so that the surface potential on the transport member is between the potential of the image portions that has been reduced by the charge of the previously developed powder and the potential of the non-image portions of the latent image carrying member, and wherein latent image forming and developing are repeated to successively develop powder in different colors that are superimposed on the same latent image carrying member.

9. An image forming apparatus comprising:

either a developing device that applies powder to a latent image carrying member to develop latent images on the latent image carrying member, or a process cartridge, wherein the developing device includes:

a transport member disposed in opposition to the latent image carrying member and having a plurality of transport electrodes that generate electric fields to transport powder;

voltage supply means for applying n phase (where n is a positive integer equal to or greater than 2) voltage to the transport electrodes; and transport member surface potential determination means for determining the surface potential of the transport member, wherein the voltage supply means applies the n phase voltage to the transport electrodes so that the surface potential on the transport member is between the potential of the image portions and the potential of the non-image portions of the latent image carrying member, and the process cartridge includes at least the developing device, and can be freely inserted into and removed from the main body of the image forming apparatus, wherein when developing the powder for a second and subsequent colors, the voltage supply means applies the n phase voltage to the transport electrodes so that the surface potential on the transport member is between the potential of the image portions that has been reduced by the charge of the previously developed powder and the potential of the non-image portions of the latent image carrying member, and wherein latent image forming and developing are repeated to successively develop powder in different colors that are superimposed on the same latent image carrying member.

10. The image forming apparatus as claimed in claim 9, further comprising potential control means for controlling the surface potential on the transport member of the developing device so that the surface potential is a value between the potential of the image portions and the potential of the non-image portions of the latent image carrying member.

11. The image forming apparatus as claimed in claim 9, wherein the transport voltage applied to the transport member of the developing device is a wave form in which a pulse voltage and a direct current bias are superimposed, and the transport voltage is controlled by adjusting the value of the direct current bias.

12. A color image forming apparatus, comprising:

a plurality of process cartridges including at least a developing device for developing latent images on a latent image carrying member by applying powder to the latent image carrying member, and which can be freely inserted into and removed from the main body of the image forming apparatus, wherein the developing device includes:

a transport member disposed in opposition to the latent image carrying member and having a plurality of transport electrodes that generate electric fields to transport powder;

voltage supply means for applying n phase (where n is a positive integer equal to or greater than 2) voltage to the transport electrodes; and transport member surface potential determination means for determining the surface potential of the transport member, wherein the voltage supply means applies the n phase voltage to the transport electrodes so that the surface potential on the transport member is between the potential of the image portions and the potential of the non-image portions of the latent image carrying member, and when developing the powder for a second and subsequent colors, the voltage supply means applies the n phase voltage to the transport electrodes so that the surface potential on the transport member is between the potential of the image portions that has been reduced by the charge of the previously developed powder and the potential of the non-image portions of the latent image carrying member, and wherein latent image forming and developing are repeated to successively develop powder in different colors that are superimposed on the same latent image carrying member.

* * * * *